US009959845B2

(12) United States Patent
Decker

(10) Patent No.: US 9,959,845 B2
(45) Date of Patent: May 1, 2018

(54) LOCKING INTONATED STRING NUT WITH TUNER MOUNT FOR STRINGED MUSICAL INSTRUMENTS AND METHODS OF USE

(71) Applicant: Gregory Scott Decker, Denver, CO (US)

(72) Inventor: Gregory Scott Decker, Denver, CO (US)

( * ) Notice: Subject to any disclaimer, the term of this patent is extended or adjusted under 35 U.S.C. 154(b) by 0 days. days.

(21) Appl. No.: 15/506,848

(22) PCT Filed: Sep. 17, 2015

(86) PCT No.: PCT/US2015/050573
§ 371 (c)(1),
(2) Date: Feb. 27, 2017

(87) PCT Pub. No.: WO2016/057178
PCT Pub. Date: Apr. 14, 2016

(65) Prior Publication Data

US 2017/0243568 A1 Aug. 24, 2017

Related U.S. Application Data

(60) Provisional application No. 62/061,116, filed on Oct. 7, 2014.

(51) Int. Cl.
*G10D 3/12* (2006.01)

(52) U.S. Cl.
CPC ..... *G10D 3/12* (2013.01)

(58) Field of Classification Search
CPC ..... G10D 3/12; G10D 3/14
See application file for complete search history.

(56) References Cited

U.S. PATENT DOCUMENTS 2,959,085 A 11/1960 Porter
3,599,524 A 8/1971 Jones
(Continued)

FOREIGN PATENT DOCUMENTS

JP 200600227570 8/2006

OTHER PUBLICATIONS

International Search Report from the KIPO International Searching Authority for PCT/US2015/050573, dated Dec. 30, 2015 (four pages).

(Continued)

*Primary Examiner* — Kimberly Lockett
(74) *Attorney, Agent, or Firm* — Startup IP Law, LLC; Terrence M. Wyles, Esq.

(57) ABSTRACT

The present inventive disclosures are generally directed to various improved versions of locking compensated nuts for fretted stringed musical instruments. Many embodiments are especially directed to improved locking compensated nuts that can be more-easily retrofitted into existing guitars and other stringed musical instruments without requiring any major reconfigurations or modifications of the base instruments, and some variations are directed to a detachably coupled tuner-mount device that will facilitate enhanced tuning capabilities because of improved vibrational communication between the instrument strings and the tuner. In addition, some improved locking compensated nuts described herein feature interchangeable compensated inserts to allow for easy adaption to alternate string sets.

43 Claims, 21 Drawing Sheets

(56) References Cited

U.S. PATENT DOCUMENTS

| | | | | |
|---|---|---|---|---|
| 3,748,945 | A | 7/1973 | Kramer | |
| 3,936,048 | A | 2/1976 | Dunlap | |
| 4,295,404 | A | 10/1981 | Smith | |
| 4,475,432 | A | 10/1984 | Stroh | |
| 4,517,874 | A | 5/1985 | Fender | |
| D280,330 | S | 8/1985 | Tanaka | |
| 4,574,678 | A * | 3/1986 | Edwards | G10D 3/12 24/134 R |
| 4,667,561 | A | 5/1987 | Storey | |
| 4,669,350 | A | 6/1987 | Gressett | |
| 4,682,610 | A | 7/1987 | Freelain | |
| RE32,863 | E | 2/1989 | Edwards | |
| 4,985,055 | A | 1/1991 | Thorne | |
| 5,481,956 | A | 1/1996 | LoJacono et al. | |
| 5,750,910 | A | 5/1998 | LoJacono | |
| 5,932,822 | A | 8/1999 | Bernstein | |
| 6,156,962 | A | 12/2000 | Poort | |
| 6,220,311 | B1 | 4/2001 | Litto | |
| 6,433,264 | B1 | 8/2002 | Gimpel | |
| 6,462,259 | B1 * | 10/2002 | Chapman | G10D 3/12 84/314 N |
| 6,508,163 | B1 | 1/2003 | Weatherill | |
| 6,637,321 | B2 | 10/2003 | Wang | |
| 6,700,043 | B2 | 3/2004 | Hirayama | |
| 6,706,957 | B1 | 3/2004 | Merkel | |
| 7,378,582 | B2 | 5/2008 | Kinoshita | |
| 7,543,978 | B2 | 6/2009 | Clement | |
| 7,750,217 | B2 | 6/2010 | Decker | |
| 8,152,873 | B2 | 4/2012 | Decker | |
| 8,354,578 | B2 | 1/2013 | Decker | |
| 2006/0042452 | A1 | 3/2006 | Brown | |
| 2010/0005949 | A1 | 1/2010 | Calcagnini | |

OTHER PUBLICATIONS

Written Opinion of the International Searching Authority (KIPO) for PCT/US2015/050573, dated Dec. 30, 2015 (none pages).

* cited by examiner

LOCKING INTONATED STRING NUT WITH TUNER MOUNT FOR STRINGED MUSICAL INSTRUMENTS AND METHODS OF USE

CROSS-REFERENCE TO RELATED APPLICATIONS

This patent application claims the priority benefit of U.S. Patent Application No. 62/061,116, filed on Oct. 7, 2014 for "Improved Locking Intonated string nut for Stringed Musical Instruments and Methods of Use", and incorporates by reference U.S. Patent Application No. 62/061,116 herein for all purposes.

In addition, this patent application discloses various improvements to intonated string nuts with locking mechanisms and shares common Inventorship with U.S. Pat. No. 8,354,578 (for "Intonated string nut With Locking Mechanism for Musical Instruments and Methods of Use"), issued on Jan. 15, 2013; U.S. Pat. No. 8,153,873 (for "Intonated string nut With Locking Mechanism for Musical Instruments and Methods of Use"), issued on Apr. 10, 2012; and U.S. Pat. No. 7,750,217 (for "Intonated string nut With Locking Mechanism for Musical String Instruments"). Accordingly, the teachings of each of the three aforementioned U.S. Patents is hereby incorporated by reference.

BACKGROUND

The inventive disclosure contained herein relates to musical string instruments with fretted fingerboards, and more specifically to an improved nut mechanism that incorporates a string length intonation adjustment means and a means for rigidly securing the strings in position in order to ensure tuning stability.

It is well known in the art that stringed musical instruments with fretted fingerboards require specific string length and string height adjustments at the bridge and at the nut fulcrum points in order for the instrument to play in tune, and also be comfortable to play. String intonation is the technique wherein the theoretical length of a string is elongated in order to compensate for the increase in pitch that naturally occurs due to an increase in a string's tension as it is deflected away from its resting position and towards the fingerboard for contact. This "compensation" allows the musical notes produced by varying a string's vibrating length at specific frets along the fingerboard to be in tune relative to each other.

Throughout most of the history of fretted string instrument manufacture, this compensation was only done at the bridge fulcrum point. During the final adjustment phase of instrument production, a luthier would pluck the string, and at a point located precisely half way between the nut and the bridge, the luthier would then lightly touch the string thereby producing the first harmonic of the open string, with that note being an octave above pitch of the open string. The luthier would then deflect the string to the twelfth fret, located precisely at one half of the string's theoretical length, and pluck it in order to produce the fretted octave note of the open string. He would then compare these harmonic octave notes and fretted octave notes repeatedly while adjusting the position of the string's bridge fulcrum point away from the nut until the harmonic and fretted notes of the string being adjusted were identical.

Unfortunately, this technique only works in regards to fretted notes. When one compares the relationship between an instrument's fretted notes, and its open string notes wherein a string is simply plucked and allowed to vibrate between its bridge and nut fulcrum points, the ideal theoretical relationship between open string frequencies and fretted string frequencies does not exist. This is because vibrating open strings are not deflected towards the fingerboard, and therefore they do not require any compensation. The open string notes will therefore be lower in frequency in relationship to the fretted notes than they should be. With this, if a player tunes his instrument to its open string notes, the only fretted note that will be in ideal relative tune with the open string's pitch will be the fretted note produced at the twelfth fret. The fretted notes above the twelfth fret will go progressively flat as you move towards the bridge, and the fretted notes below the twelfth fret will go progressively sharp as you move towards the nut. A means must be used to restore the ideal relationship between open string and fretted note frequencies.

In an attempt to correct this difficulty and allow both open stings notes and fretted notes to be in relative tune with each other, the idea of additionally compensating a string's length at the nut in order to restore the ideal ratio between open string and fretted note frequencies has found its way into the art. Non-adjustable examples of this concept can be found in U.S. Pat. No. 4,295,404, U.S. Pat. No. 6,156,962, and U.S. Pat. No. 6,433,264. An adjustable example of a compensated string nut can be found in U.S. Pat. No. 5,750,910.

Another notable and recent attempt to deal with these tuning issues is disclosed in U.S. Pat. No. 7,378,582 to Kinoshita (Kinoshita). Kinoshita discloses a uniform projection that spans across the entire front of the string nut assembly. While the Kinoshita projection may or may not improve the intonation features of the musical instrument, it fails to provide each string-nut fulcrum with a varying linear position in relation to each individual string. In other words, Kinoshita merely applies the same linear position to each instrument string, treating all the strings uniformly and thus fails to ensure the ideal tuning of each string.

Furthermore, additional difficulties in keeping the instrument in proper tune arise with the usage of vibrato mechanisms. These mechanisms allow the player to vary the tension of the strings during play in order to produce a wide range of frequency related effects, most notably vibrato, which is a periodic change in a string's frequency. These mechanisms are difficult to use in that the return of a string to its original tension is very difficult to achieve because these mechanisms typically use springs for their restoring force. Changes in temperature, friction of a string's contact points at the bridge and nut, the stability of a string's material, and variations in the holding position of a string's tuning mechanism as a string's tension changes during vibrato mechanism usage all combine to make the tuning and stability of string tensions during play very difficult to achieve.

There are a variety of mechanisms within the art that provide the player with a means for eliminating string slippage at the nut in order to improve the tuning stability of the instrument. With each mechanism, the player rigidly secures a length of each string between two flat surfaces. U.S. Pat. No. 4,517,874, U.S. Pat. No. Des. 280,330, and U.S. Pat. No. 4,475,432 each show string-locking mechanisms that require the usage of an Allen wrench to secure the string between two flat surfaces. U.S. Pat. No. 4,574,678, U.S. Pat. No. 4,667,561, U.S. Pat. No. 4,669,350, U.S. Pat. No. 5,932,822, and U.S. Pat. No. Re. 32,863 each illustrate string-locking mechanisms that can be engaged manually by the player without the need for using a tool.

An effective combination of a string-locking mechanism with a tuning-compensation schema is taught by U.S. Pat.

No. 8,354,578, U.S. Pat. No. 8,153,873, and U.S. Pat. No. 7,750,217. However, while effective, the compensated locking nuts described therein typically require modifying/cutting into the neck of existing guitars (or other fretted stringed instruments) that have already been configured for existing nuts on the market, which are based on fairly standard industry sizing. Many in the music industry would be resistant to making such permanent modifications to their cherished instruments. What is needed for such situations is a similar compensated locking nut that is sized and adapted to fit into the existing nut-receiving cavities in the necks of existing guitars (and similar fretted stringed instruments), yet is still able to deliver the compensation required to keep the instrument in tune after locking the strings.

Another issue with respect to existing locking compensated nuts is that their bases, which contain the compensated fulcrums (i.e., string cutouts at prescribed depths relative to the main face of the nut), are manufactured as one unit and may not be appropriately sized radially for a given string set that a user may want to convert to. What is needed is a locking compensated nut that is adapted to facilitate the use of different radial-nut configurations and multiple string-compensation schemas.

In addition, those in the music industry that use compensated nuts also recognize the importance of maintaining their instruments in tune. However, as strings yield under tension over time, professional musicians will periodically re-string their instruments and check the tuning with a tuning instrument/calibrator ("tuner"), many models of which are commercially widely available in the market. Examples of such tuners are SNARK® SN-1 Guitar & Bass Tuner, INTELLITOUCH™ PT10 Mini Clip-On Tuner, FISHMAN® FT-1 Digital Tuner, PETERSON™ StroboClip SC-1 Clip-On Strobe Tuner, and many others. Such tuners typically have a clamping device for attachment to the wooden headstock above both the neck and the string nut. This location of the tuner is required simply because there are no other convenient mounts for the tuner device. Unfortunately, locating the tuner on the headstock adds a certain amount of vibrational attenuation between the strings that the musician is trying to tune and the tuner; that is, the string vibrations must travel to the tuner through the wood or composite medium that the neck and headstock are made from. Ideally, a tuner should be in direct vibrational communication with the strings being tuned. What is needed is a means to be able to detachably, yet securably mount a tuner onto a guitar (or similar fretted stringed instrument) such that the tuner is able to receive high-fidelity vibrations from the string(s) being tuned with minimal attenuation.

BRIEF SUMMARY

The present inventive disclosures are generally directed to improved versions of locking compensated nuts for stringed musical instruments. In some embodiments, said improvements allow for the installation of an effective locking compensated nut on an existing guitar (or other existing fretted stringed instrument) without having to modify the existing instrument. In previous versions of the locking compensated nut, for example, a user of a standard guitar is required to remove the existing nut from its existing receiving cutout in the guitar neck, then cut/machine the cutout in the guitar neck to extend the length of that cutout along the neck by approximately 1/16 in. so that it will receive the new compensated nut. To avoid this reconfiguration of an existing guitar neck, in some embodiments of the existing improved locking compensated nut, the base of the nut is sized to be received by the existing neck cutout, while also comprising a raised shelf that contains the compensated fulcrums and that extends beyond the original cutout by approximately 1/16 in., or to extend by a length to compensate for whatever standard nut size the base will fit into.

In other embodiments of the improved locking compensated nut, whether for existing guitar installations requiring the raised-extended shelf schema described supra or whether for a nut for a new guitar installation that does not require said raised-extended shelf schema, the improved nut's compensation fulcrums are contained in an interchangeable insert into the base of the nut, wherein different compensation schema (that is, fulcrum cutout depths relative to the face of the nut) and/or different string-nut radius schema can be employed by a user for their instrument/string set.

Finally, in other embodiments of an improved locking nuts, the locking fasteners are specifically designed to not only lock-down the strings, but are also adapted to slidably receive a tuner-mount member, which when installed provides a convenient mounting point for a tuner and puts the mounted tuner in immediate vibrational communication with the strings at the pint of the locking mechanism at the nut. Notably, it would be appreciated by one ordinarily skilled in the art that the specialized locking fasteners and tuner-mount member can be used with either a compensated locking nut or an uncompensated locking nut.

The foregoing Brief Summary is intended to merely provide a short, general overview of the inventive disclosure described throughout this document, and therefore, is not intended to limit the scope of the inventive disclosure contained throughout the balance of this document and its appended claims and drawings.

BRIEF DESCRIPTION OF THE DRAWINGS

FIGS. 2D-1 through 2D-2 depict one embodiment of the top and end views, respectively, of a modular, interchangeable insert for a locking compensated nut.

FIGS. 2E-1 through 2E-2 depict one embodiment of the top and end views, respectively, of the base member of a locking compensated nut, adapted to receive a modular, interchangeable insert.

BRIEF DESCRIPTION

I. Overview

Figure 1A:
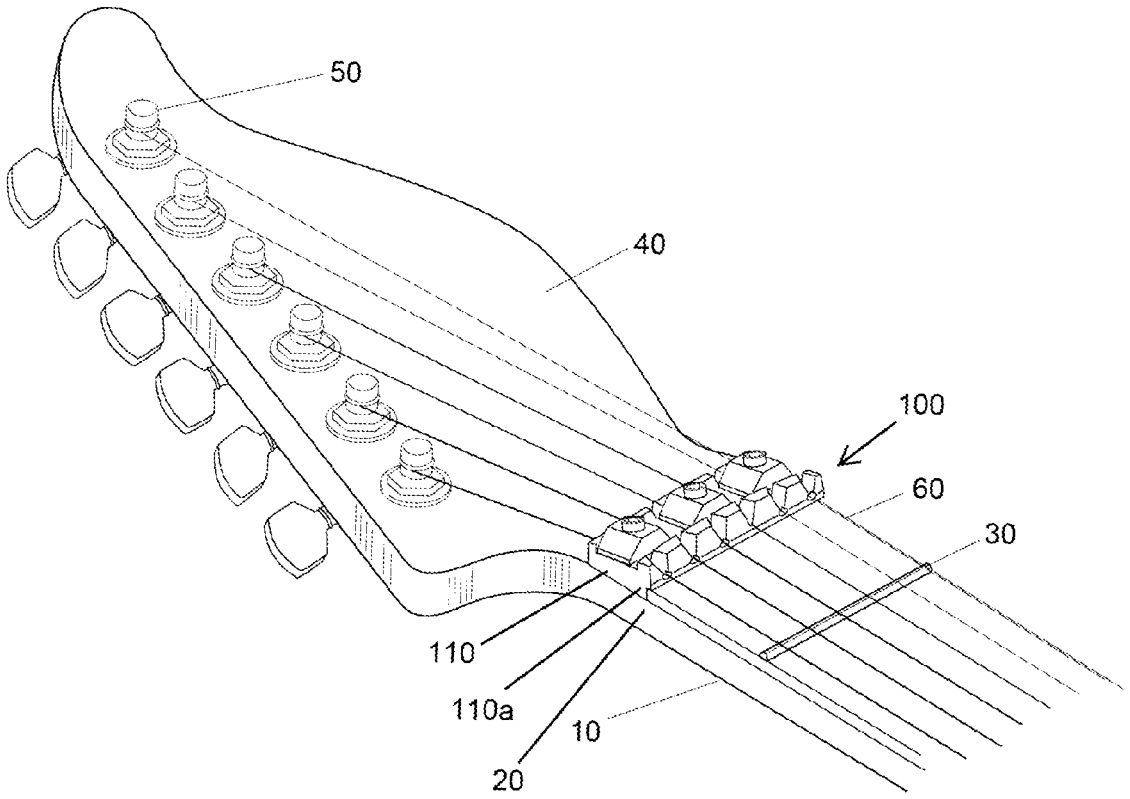
FIG. 1A depicts one embodiment of an isometric view of a locking compensated nut installed on the neck of a guitar, wherein the nut comprises a raised shelf that contains the compensated fulcrums 175 and that extends beyond the original cutout in the neck of the guitar.

The present inventive disclosures are generally directed to various improved versions of locking compensated nuts for fretted stringed musical instruments. Many embodiments are especially directed to improved locking compensated nuts that can be more-easily retrofitted into existing guitars and other stringed musical instruments without requiring any major reconfigurations or modifications of the base instruments, and some variations are directed to a detachably coupled tuner-mount device that will facilitate enhanced tuning capabilities because of improved vibrational communication between the instrument strings and the tuner. In addition, some improved locking compensated nuts described herein feature interchangeable compensated inserts to allow for easy adaption to alternate string sets.

II. Terminology

The terms and phrases as indicated in quotes (" ") in this section are intended to have the meaning ascribed to them in this Terminology section applied to them throughout this document, including the claims, unless clearly indicated otherwise in context. Further, as applicable, the stated definitions are to apply, regardless of the word or phrase's case, to the singular and plural variations of the defined word or phrase.

The term "or", as used in this specification and the appended claims, is not meant to be exclusive; rather, the term is inclusive, meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of the phrase "in one embodiment" and/or "in one variation" and similar phrases in various places in the specification are not necessarily all meant to refer to the same embodiment.

The term "couple" or "coupled", as used in this specification and the appended claims, refers to either an indirect or a direct connection between the identified elements, components, or objects. Often the manner of the coupling will be related specifically to the manner in which the two coupled elements interact.

The term "removable", "removably coupled", "readily removable", "readily detachable", "detachably coupled", and similar terms, as used in this patent application specification (including the claims and drawings), refer to structures that can be uncoupled from an adjoining structure with relative ease (i.e., non-destructively and without a complicated or time-consuming process) and that can also be readily reattached or coupled to the previously adjoining structure.

Directional and/or relational terms such as, but not limited to, left, right, nadir, apex, top, bottom, vertical, horizontal, back, front, and lateral are relative to each other, are dependent on the specific orientation of an applicable element or article, are used accordingly herein to aid in the description of the various embodiments, and are not necessarily intended to be construed as limiting in this specification and the appended claims.

As applicable, the terms "about" or "generally", as used herein unless otherwise indicated, means a margin of +−20%. Also, as applicable, the term "substantially" as used herein unless otherwise indicated means a margin of +−10%. It is to be appreciated that not all uses of the above terms are quantifiable such that the referenced ranges can be applied.

III. An Intonated Locking Nut for Retrofitting in a Stringed Musical Instrument Refer to FIGS. 1A-1G; and 4A-4F. This Section III is generally directed to an improved locking compensated nut for fretted stringed musical instruments. Said improvements allow for the installation of an effective locking compensated nut 100 on an existing guitar (or other existing fretted 30 stringed instrument) without having to modify the existing instrument; that is, make additional cuts into the neck 10 of the existing guitar (typically, an additional 1/16 inch cutout) so that its nut-receiving cutout will be of a sufficient size to receive a compensated nut. In some embodiments of the improved locking compensated nut 100, the base 110 of the nut 100 is sized to be received by the existing neck 10 cutout, while also comprising a raised shelf that contains the compensated fulcrums 175 that extends beyond the original cutout by approximately 1/16 in., or to extend by a length to compensate for whatever standard nut size the nut base 110 will fit into.

Figure 1B:
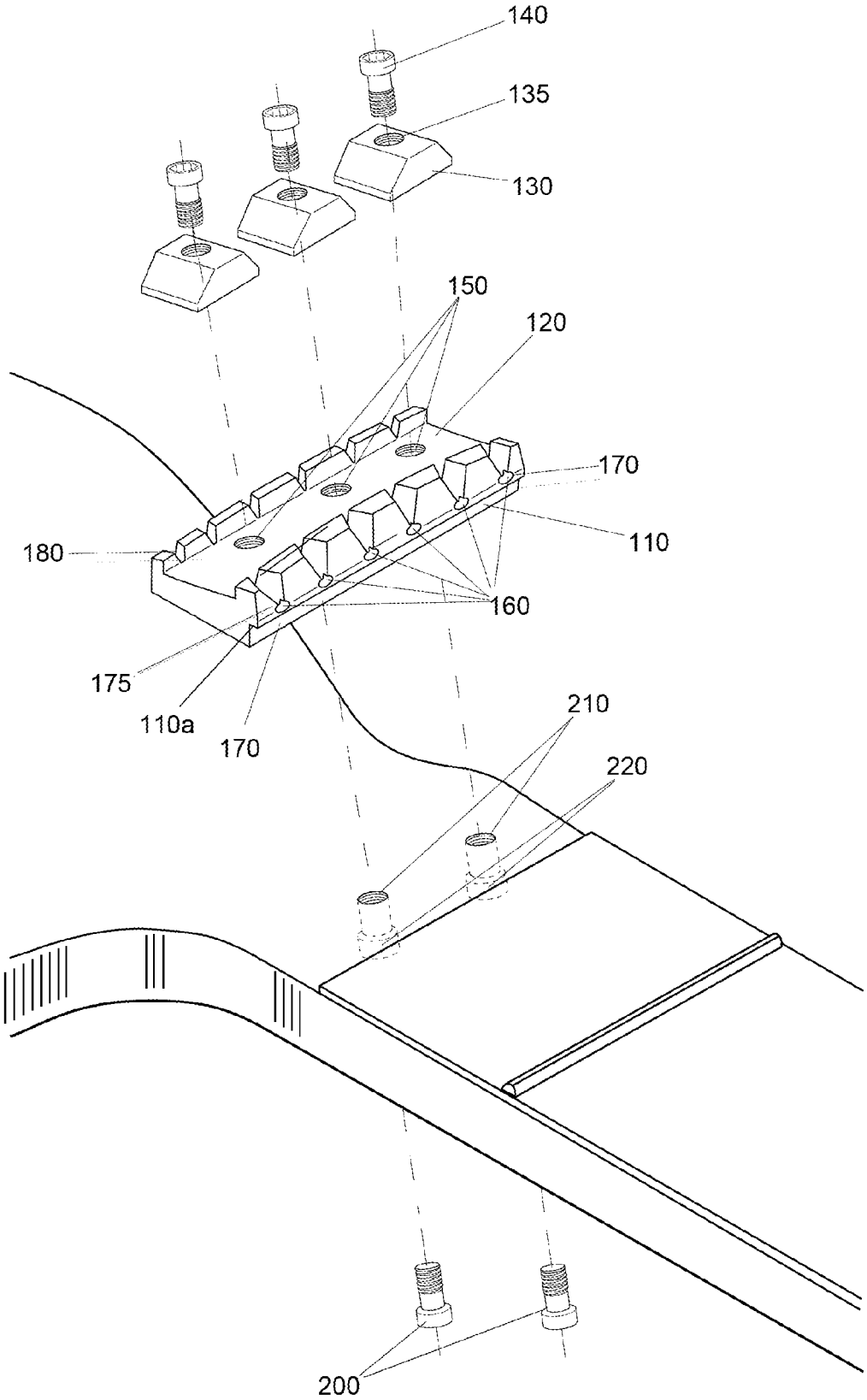
FIG. 1B depicts one embodiment of an exploded isometric view of a locking compensated nut installed on the neck of a guitar, wherein the nut comprises a raised shelf that contains the compensated fulcrums and that extends beyond the original cutout in the neck of the guitar.

FIG. 1B illustrates a perspective exploded view of the preferred embodiment of the present device 100. As can be seen, the present device 100 includes a base plate 110, string-locking plate channel 120, string-locking plates 130 that include string-locking-plate slip-fit through holes 135, string-locking-plate bolts 140, string-locking-plate threaded holes 150, front elongated v-shaped string guides 160, string intonation cutouts 170 with intonated string-nut fulcrums 175 (also called compensation fulcrums), and rear elongated v-shaped string guides 180, string-nut-securing thread holes 155, and string-nut-securing bolts 200. Through-neck, counter-bored, slip-fit holes 210 with boss' 220 within neck 10 is a common feature used by guitar manufacturers. Notably, the improved nut's 100 fulcrums 175, intonation cutouts 170, and v-shaped string guides 160 located at the front face of the nut 100 are disposed on a protruding front shelf 110*a* above the base 110, whereby said shelf extends past the guitar's pre-existing nut-receiving cutout by a predetermined length (typically roughly 1/16 of an inch) so that the improved nut can be disposed within the guitar's existing nut-receiving cutout, yet the compensated nut 100 will still be long-enough to be effective. This type of schema can be used for different lengths of said extended shelf in the event that a stringed musical instrument is encountered with a non-standard (or differently standardized) nut-receiving cutout.

By placing the present device 100 in position above through-neck counter-bored slip-fit holes 210 wherein string-nut-securing thread holes 155 are in alignment with said through-neck slip-fit counter-bored holes 210, and then by placing string-nut-securing bolts 200 within said through-neck slip-fit counter-bored holes 210, and rotating said string-nut-securing bolts 200 until they engage with and are rigidly torqued against the threads of string-nut-securing thread holes 155 and boss 220 of said through-neck counter-bored slip-fit holes 210, the present device 100 finds rigid position securement on the instrument at the proper location between the fingerboard 20 and the headstock 40 on the neck 10.

The extended shelf on the nut 100 containing the front elongated v-shaped string guides 160 and intonation cutouts 170 with intonated string-nut fulcrums 175, and along with the rear elongated v-shaped string guides 180, provide the means for guiding and positioning the strings 60 in the proper location while also providing the means for supplying the additional compensated string length required for the open string notes and the fretted string notes to stay in relative tune with each other during play. The elongated v-shape of each front elongated v-shaped string guide 160 and rear elongated v-shaped string guide 180 helps to aid in the initial attachment and final positioning of the string. The side of each string guide provides a surface for the string to follow to its final position located in the bottom center where the intonated string-nut fulcrums 175 are located.

Figure 1C:
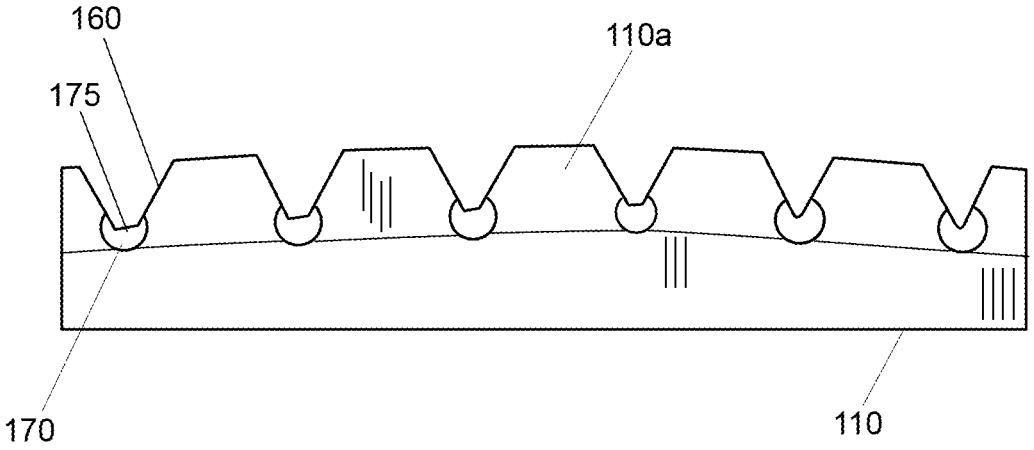
FIG. 1C depicts one embodiment of the front view of the compensation part of the locking compensated nut; that is, looking at the compensated cutouts for the plurality of fulcrums.

FIG. 1C shows a front view of base plate 110 with extended shelf 110*a*. As can be seen, front elongated v-shaped string guides 160, string intonation cutouts 170, and the fronts of the intonated string-nut fulcrums 175 are shown. In the manufacturing process, a small endmill can be used to fabricate the string intonation cutouts 170, and the depth of each of the intonated string-nut fulcrums 175 in a single plunging operation. The circular shape of each of the string intonation cutouts 170 is very beneficial in that a minimum of material needed be removed, and it provides for a smooth top edge of the front of base plate 110 thereby eliminating any potential for accidental damage to the player's hand. However, other shapes and/or fabrication strategies can be used to create the intonated string-nut fulcrums 175.

Figure 1D:
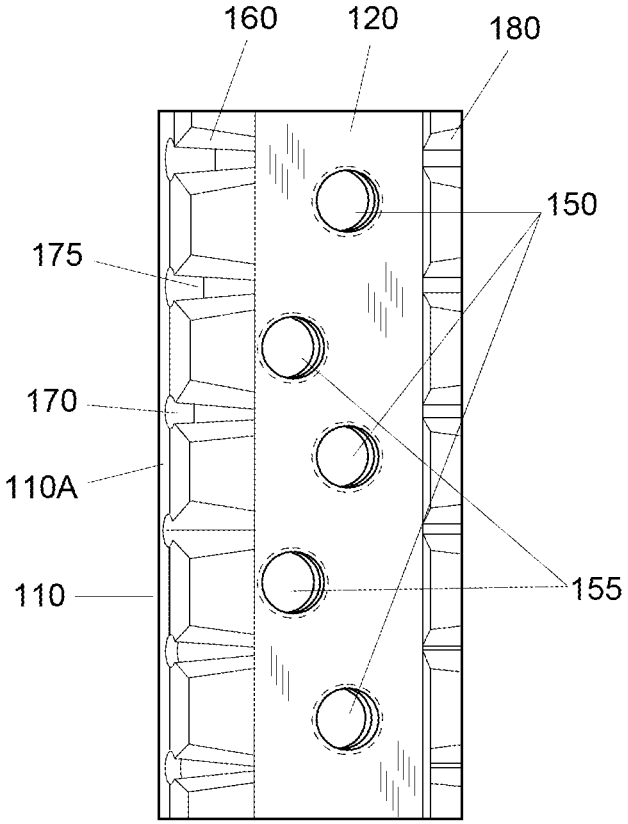
FIG. 1D depicts one embodiment of the top view of the locking compensated nut without the lock-down members installed.

A top view of base plate 110 is shown in FIG. 1D. This figure clearly shows the varying depths of each of the string intonation cutouts 170 relative to the front face 110*a*, and therefore the varying linear position of each string's intonated string-nut fulcrum 175, thereby providing for the desired amount of compensation for each string. As can be appreciated, the ideal compensated length amount for each string will vary with the overall scale length of the instrument, and with the diameter and type of strings chosen by the player. String-locking-plate channel 120, string-locking-plate thread holes 150, rear elongated v-shaped string guides 180, and string-nut-securing thread holes 155 are also shown.

Figure 1E:
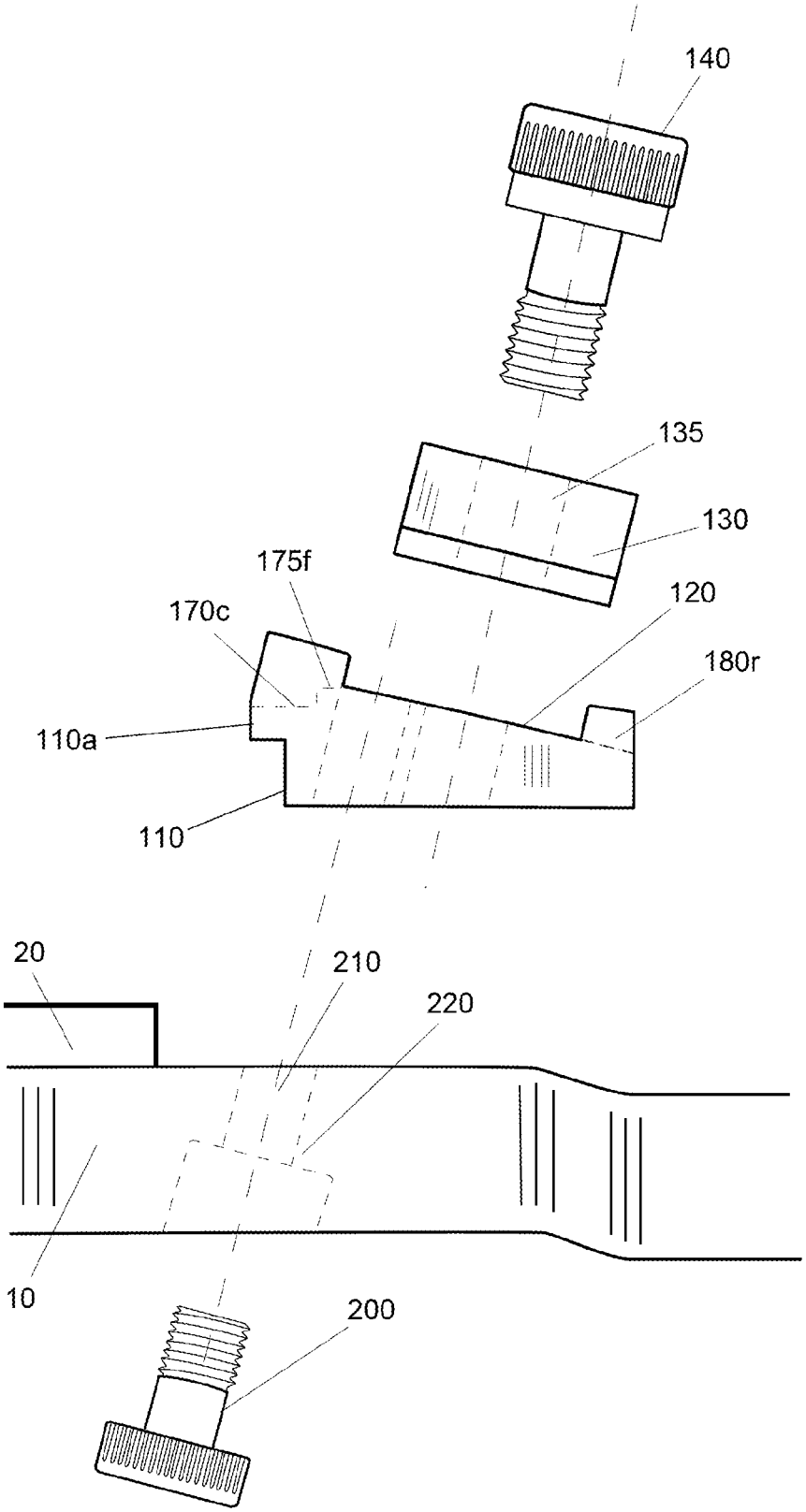
FIG. 1E depicts one embodiment of an exploded side view of the installation of a locking compensated nut on a guitar neck with a pre-existing, standard-sized nut-receiving cutout on the guitar neck.

In FIG. 1E, an exploded side view of the present device is shown. Dashed lines 170*c* and 175*f* illustrate the configuration of string intonation cutouts 170 and intonated string-nut fulcrums 175 with respect to the extended shelf 110*a*. Dashed line 180*r* illustrates the bottom face of rear elongated v-shaped string guide 180. By slipping string-locking-plate bolt 140 through string-locking-plate slip-fit through hole 135 of string-locking-plate 130, aligning it with string-locking-plate threaded hole 150 and rotating it until the bottom surface of the head of string-locking-plate bolt 140 is in contact with the top of string-locking-plate 130 and the threads of string-locking-plate bolts 140 are securely torqued against the complementary mating threads of string-locking-plate threaded holes 150 by means of a wrench, each string will be compressed and rigidly held in position between the fixed surface at the bottom of s string-locking-plate channel 120 and the bottom face of string lock 130, thereby providing for an improvement in string tension stability especially when used in combination with a vibrato mechanism. Common vibrato mechanisms comprise a lockable floating vibrato bridge and arm assembly, similar to those discussed in U.S. Pat. No. 4,638,711 to Stroh and in U.S. Pat. No. 5,311,804 to Wilkinson, for example.

Figure 1F:
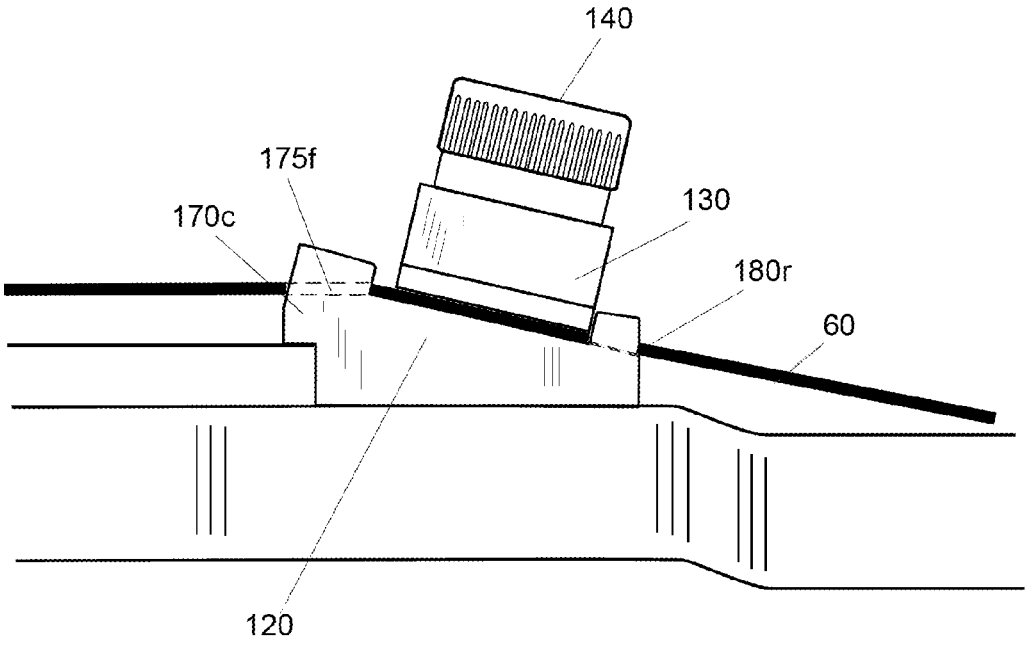
FIG. 1F depicts one embodiment of a side view of the fully installed locking compensated nut depicted in FIG. 1E.

FIG. 1F illustrates an assembled side view of the present device, with the extended shelf 110*a*. As can be seen by the dashed line 170*c*, string intonation cutout 170 provides relief below string 60, and the bottom of string 60 is in contact with intonated string-nut fulcrum illustrated by dashed line 175*f*. It can also be seen that the depth of string intonation cutout 170 determines the linear position of the front of intonated string-nut fulcrum 175, and therefore the amount of intonation provided to each string 60. The locking feature of the present device is also clearly indicated. As is seen, a portion of each string 60 is rigidly compressed between the bottom of string-locking-plate channel 120 and the bottom of string-locking plate 130.

Figure 1G:
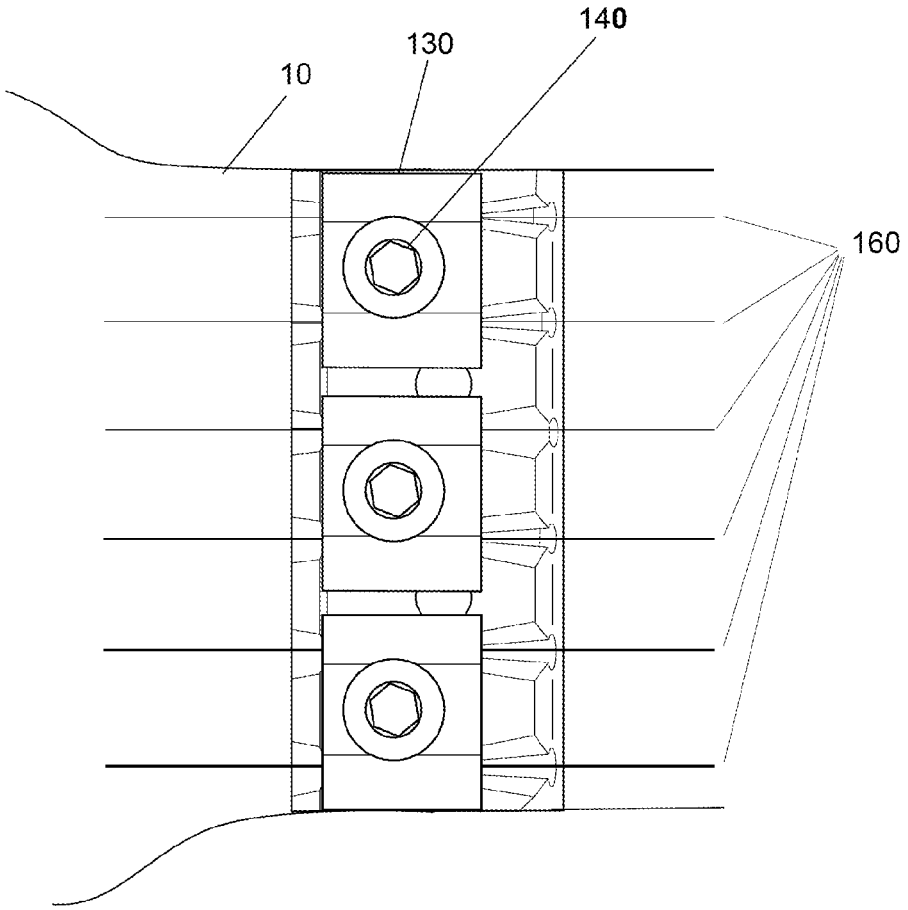
FIG. 1G depicts one embodiment of a top view of the fully installed locking compensated nut depicted in FIG. 1E.

A top view of the present device fully assembled is seen in FIG. 1G. As is clearly seen, each string is provided a specific amount of compensation, and each is rigidly locked into linear position by means of compressing each string between a fixed surface and a variable height surface.

Variations of the embodiments described in this Section III are shown in FIGS. 4A-4F, in which the base 110 may include an elongated and angled extended section 230 to accommodate some guitar manufacturer's specialized label-plate/ornamentation needs. For example, many Gibson® guitars typically have such an extension from the guitar's string nut. FIGS. 4A-4F depict the angled extension 230 disposed onto the headstock 40 of a guitar. In variations, an overlaid label plate 240 is fixedly coupled onto the extension 230. The extension 230 and label plate 240 (if included) are typically secured to the headstock 40 via threaded fasteners 235. Regardless, of the presence of such extensions, for purposes of interpreting the claims in this disclosure, the rear position of the base 110 at which rear elongated v-shaped string guides 180 may be disposed is considered to be roughly at the point the extension member 230 begins and angles away from the main plane of the base 110.

IV. An Intonated Locking Nut for Retrofitting in a Stringed Musical Instrument, Featuring a Modular Compensating Insert Refer to FIGS. 2A-2H. This Section IV is generally directed to an improved locking compensated nut for fretted stringed musical instruments, with some variations thereof similar to the disclosure discussed in Section III, supra, and with other variations thereof similar to those discussed in U.S. Pat. No. 8,354,578 (for "Intonated string nut With Locking Mechanism for Musical Instruments and Methods of Use"), U.S. Pat. No. 8,153,873 (for "Intonated string nut With Locking Mechanism for Musical Instruments and Methods of Use"), and U.S. Pat. No. 7,750,217 (for "Intonated string nut With Locking Mechanism for Musical String Instruments"). However, a key difference is the provision of the ability for end users to customize the nut's 100 compensation fulcrums 175 and/or the string-radius schema across the nut 100 by using an interchangeable insert 185 into the base 110 of the nut 100, wherein different compensation schema (that is, fulcrum cutout 170 depths relative to the face of the nut 100) and/or different string-nut radius schema can be employed by a user for their instrument/string set. FIGS. 2A-2H and this description is directed primarily to one variation, wherein the insert 185 provides an extended shelf such as described in Section III, supra. However, the basic concept is not so limited to such variations, as would be appreciated by those ordinarily skilled in the art. In fact, the use of the interchangeable inserts 185 can be applied to the locking compensated nuts described in the aforementioned U.S. patents.

Turning back to the immediate example variation, the base 110 of the nut 100 is sized to be received by the existing neck 10 cutout, while also comprising a raised shelf that contains the compensated fulcrums 175 and that extends beyond the original cutout by approximately 1/16 in., or to extend by a length to compensate for whatever standard nut size the nut base 110 will fit into.

Figure 2A:
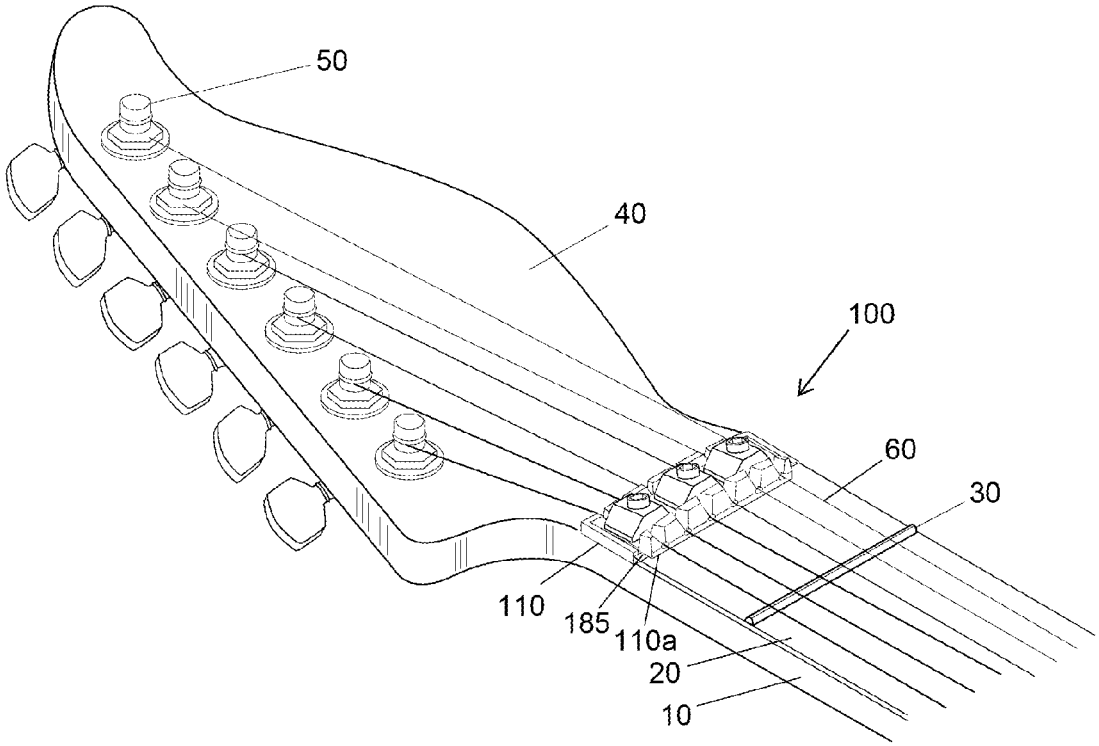
FIG. 2A depicts one embodiment of an isometric view of a locking compensated nut installed on the neck of a guitar, wherein the nut comprises a modular, interchangeable insert member with an extended shelf, which contains compensated fulcrums and can accommodate nuts of differing radius, that extends beyond the original cutout in the neck of the guitar.
Figure 2B:
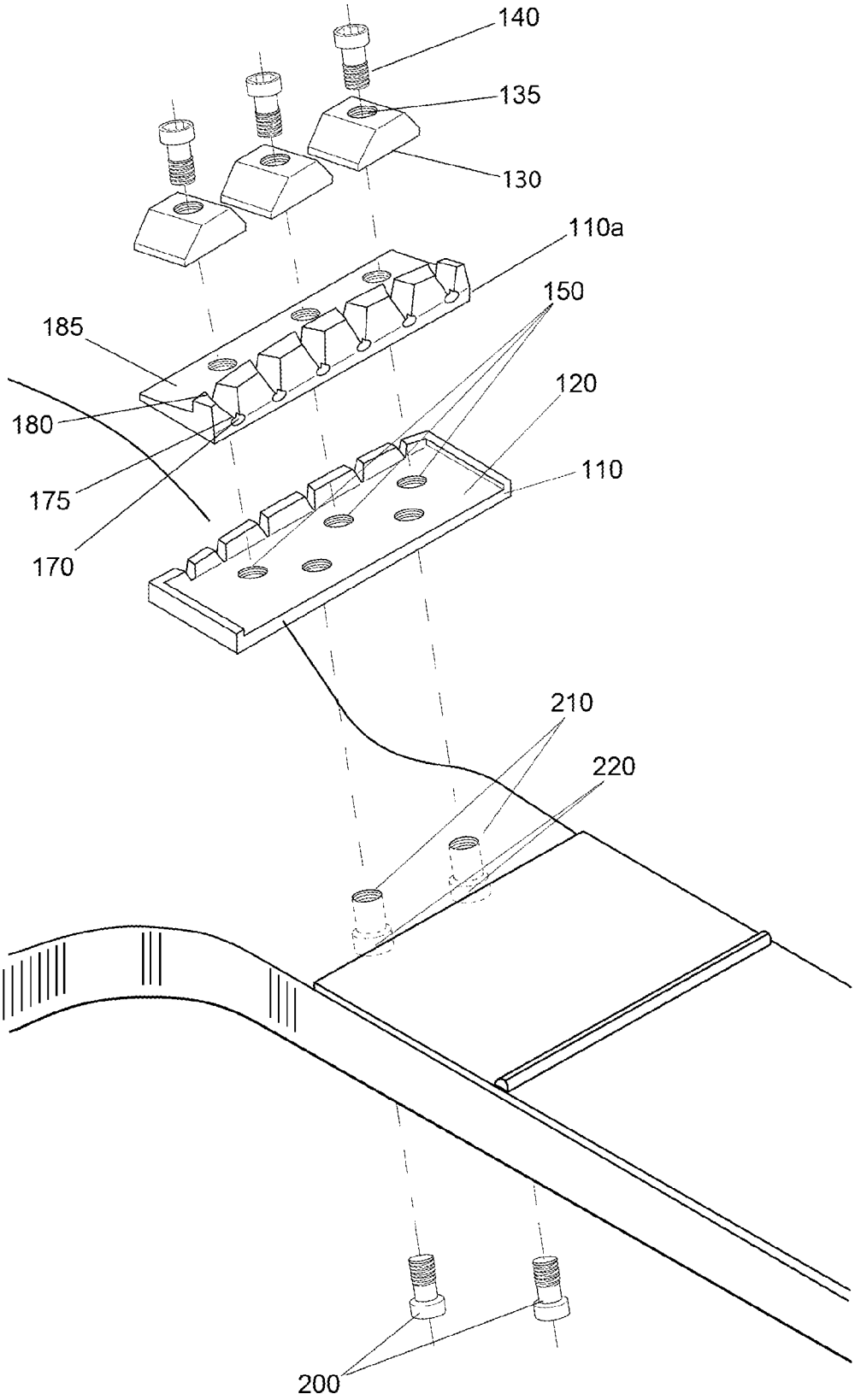
FIG. 2B depicts one embodiment of an exploded isometric view of a locking compensated nut installed on the neck of a guitar, wherein the nut comprises a modular, interchangeable insert member with an extended shelf, which contains compensated fulcrums and can accommodate nuts of differing radius, that extends beyond the original cutout in the neck of the guitar.

FIG. 2B illustrates a perspective exploded view of the preferred embodiment of the present device 100. As can be seen, the present device 100 includes a base plate 110, string-locking plate channel 120, string-locking plates 130 that include string-locking-plate slip-fit through holes 135, string-locking-plate bolts 140, string-locking-plate threaded holes 150, an interchangeable insert member 185 (with front elongated v-shaped string guides 160, string intonation cutouts 170, and intonated string-nut fulcrums 175 (also called compensation fulcrums), and rear elongated v-shaped string guides 180, string-nut-securing thread holes 155, and string-nut-securing bolts 200. Through-neck, counter-bored, slip-fit holes 210 with boss' 220 within neck 10 is a common feature used by guitar manufacturers. Notably, the improved nut's 100 fulcrums 175, intonation cutouts 170, and v-shaped string guides 160 located at the front face of the nut 100 are disposed on a protruding front shelf 110*a* above the base 110, whereby said shelf extends past the guitar's pre-existing nut-receiving cutout by a predetermined length (typically roughly 1/16 of an inch) so that the improved nut 100 can be disposed within the guitar's existing nut-receiving cutout, yet the compensated nut 100 will still be long-enough to be effective. As will be appreciated by those ordinarily skilled in the art, this type of schema can be used for different lengths of said extended shelf in the event that a stringed musical instrument is encountered with a non-standard (or differently standardized) nut-receiving cutout 20.

By placing the present device 100 in position above through-neck counter-bored slip-fit holes 210 wherein string-nut-securing thread holes 155 are in alignment with said through-neck slip-fit counter-bored holes 210, and then by placing string-nut-securing bolts 200 within said through-neck slip-fit counter-bored holes 210, and rotating said string-nut-securing bolts 200 until they engage with and are rigidly torqued against the threads of string-nut-securing thread holes 155 and boss 220 of said through-neck counter-bored slip-fit holes 210, the present device 100 finds rigid position securement on the instrument at the proper location between the fingerboard 20 and the headstock 40 on the neck 10.

The interchangeable insert 185 with the extended shelf 110*a* containing the front elongated v-shaped string guides 160 and intonation cutouts 170 with intonated string-nut fulcrums 175, and along with the rear elongated v-shaped string guides 180, provide the means for guiding and positioning the strings 60 in the proper location while also providing the means for supplying the additional compensated string length required for the open string notes and the fretted string notes to stay in relative tune with each other during play. The elongated v-shape of each front elongated v-shaped string guide 160 and rear elongated v-shaped string guide 180 helps to aid in the initial attachment and final positioning of the string. The side of each string guide provides a surface for the string to follow to its final position located in the bottom center where the intonated string-nut fulcrums 175 are located.

FIGS. 2C-1 through 2C-3 each shows a front view of interchangeable insert 185. As can be seen, front elongated v-shaped string guides 160, string intonation cutouts 170, and the fronts of the intonated string-nut fulcrums 175 are shown. In the manufacturing process, a small endmill can be used to fabricate the string intonation cutouts 170, and the depth of each of the intonated string-nut fulcrums 175 in a single plunging operation. The circular shape of each of the string intonation cutouts 170 is very beneficial in that a minimum of material needed be removed, and it provides for a smooth top edge of the front of base plate 110 thereby eliminating any potential for accidental damage to the player's hand. In addition, the radius (or arc) of the inserts 185 can be different from one another to match the architecture of the intended stringed musical instrument.

Figures 1, 2C:
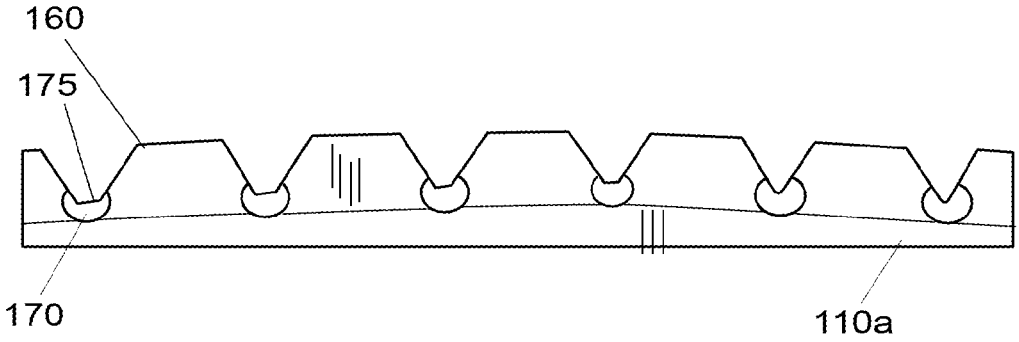
FIGS. 2C-1 through 2C-3 each depicts an example ("small", "medium", and "large") front view of a locking compensated nut insert adapted for a specific guitar radius.
Figures 2, 2C:
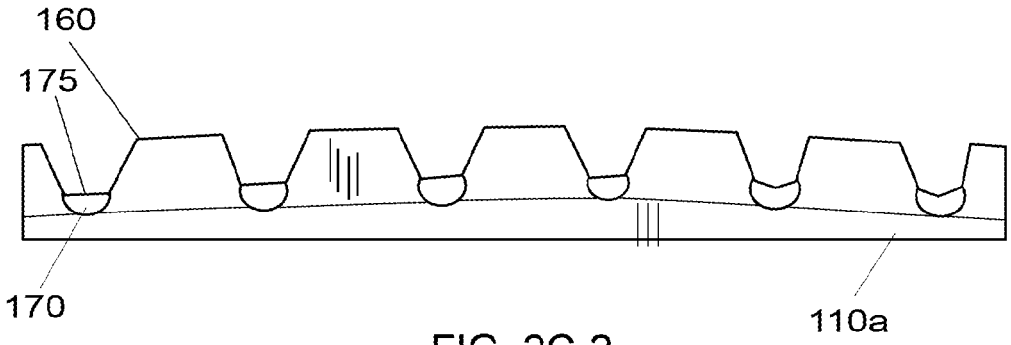
Figures 2, 2C, 3:
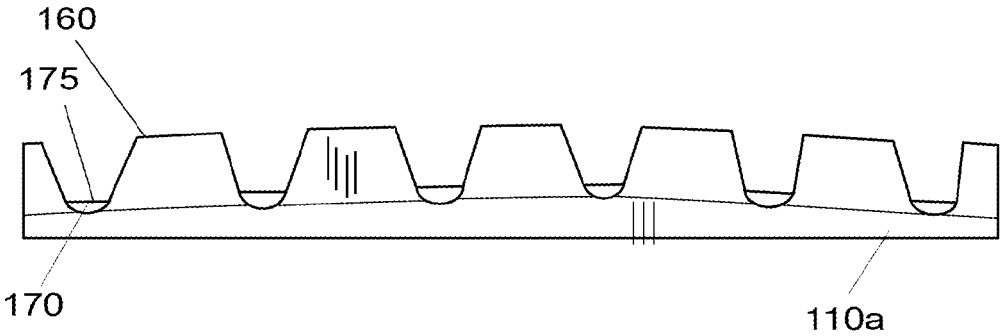
Figures 1, 2D:
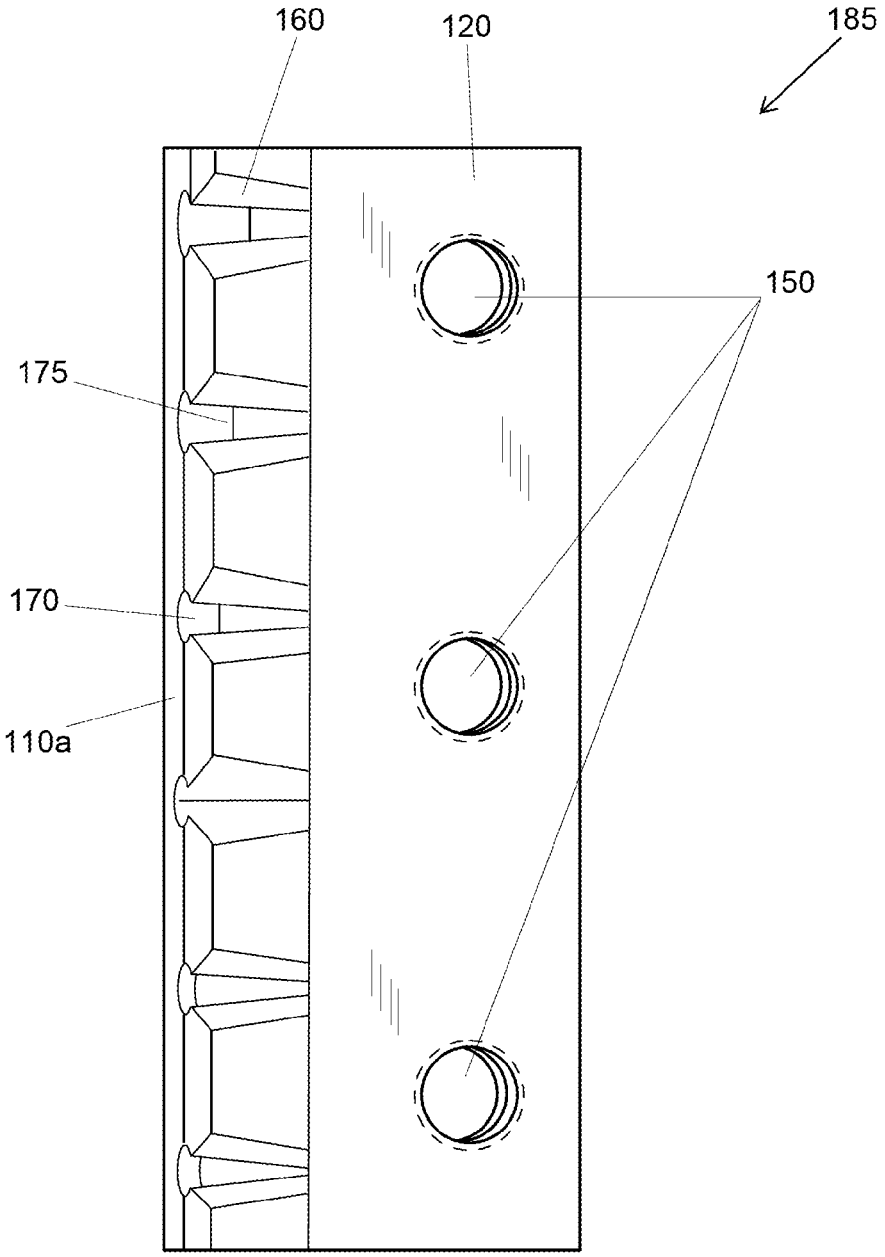
Figures 2, 2D:
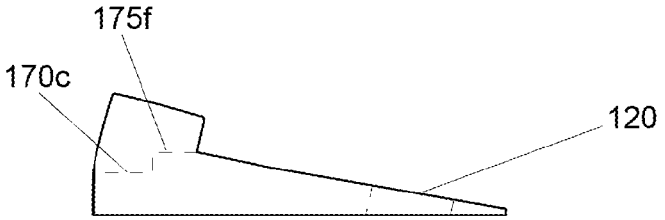

Top and end views of the interchangeable insert 185 are shown, respectively in FIGS. 2D-1 and 2D-2. This figure clearly shows the varying depths of each of the string intonation cutouts 170 relative to the front face 110*a*, and therefore the varying linear position of each string's intonated string-nut fulcrum 175, thereby providing for the desired amount of compensation for each string. As can be appreciated, the ideal compensated length amount for each string will vary with the overall scale length of the instrument, and with the diameter and type of strings chosen by the player. String-locking-plate channel 120, and string-locking-plate thread holes 150 are also shown.

Figures 1, 2E:
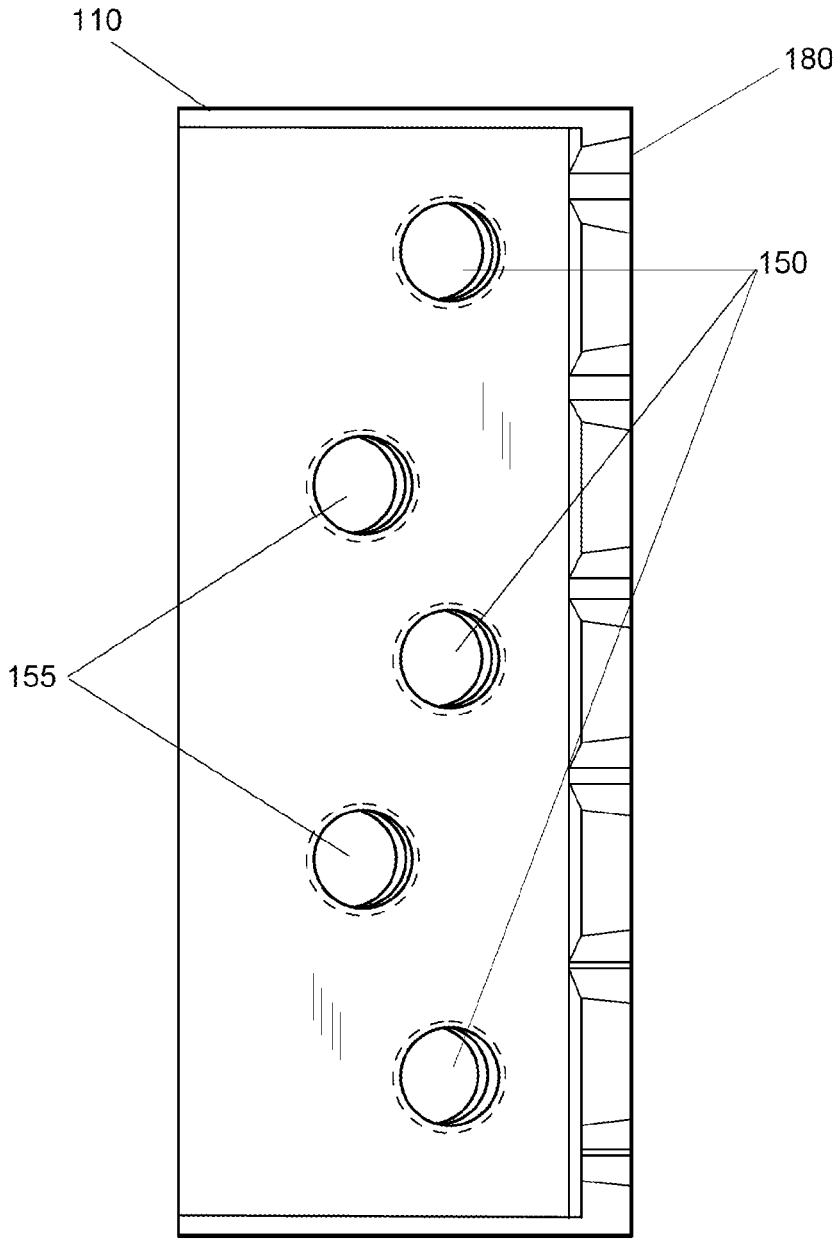
Figures 2, 2E:
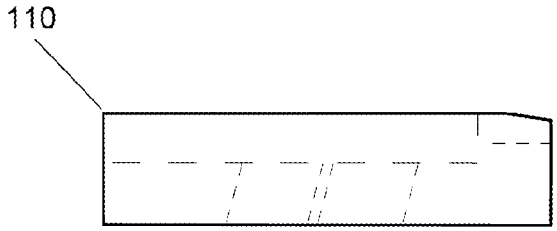

FIGS. 2E-1 and 2E-2 show the top and end views of the base plate 110 onto which an insert member 185 is installed. Shown are the rear string guide v-channels 180, string-locking-plate thread holes 150, and the threaded holes 155 for securing the nut to the guitar neck 10.

Figure 2F:
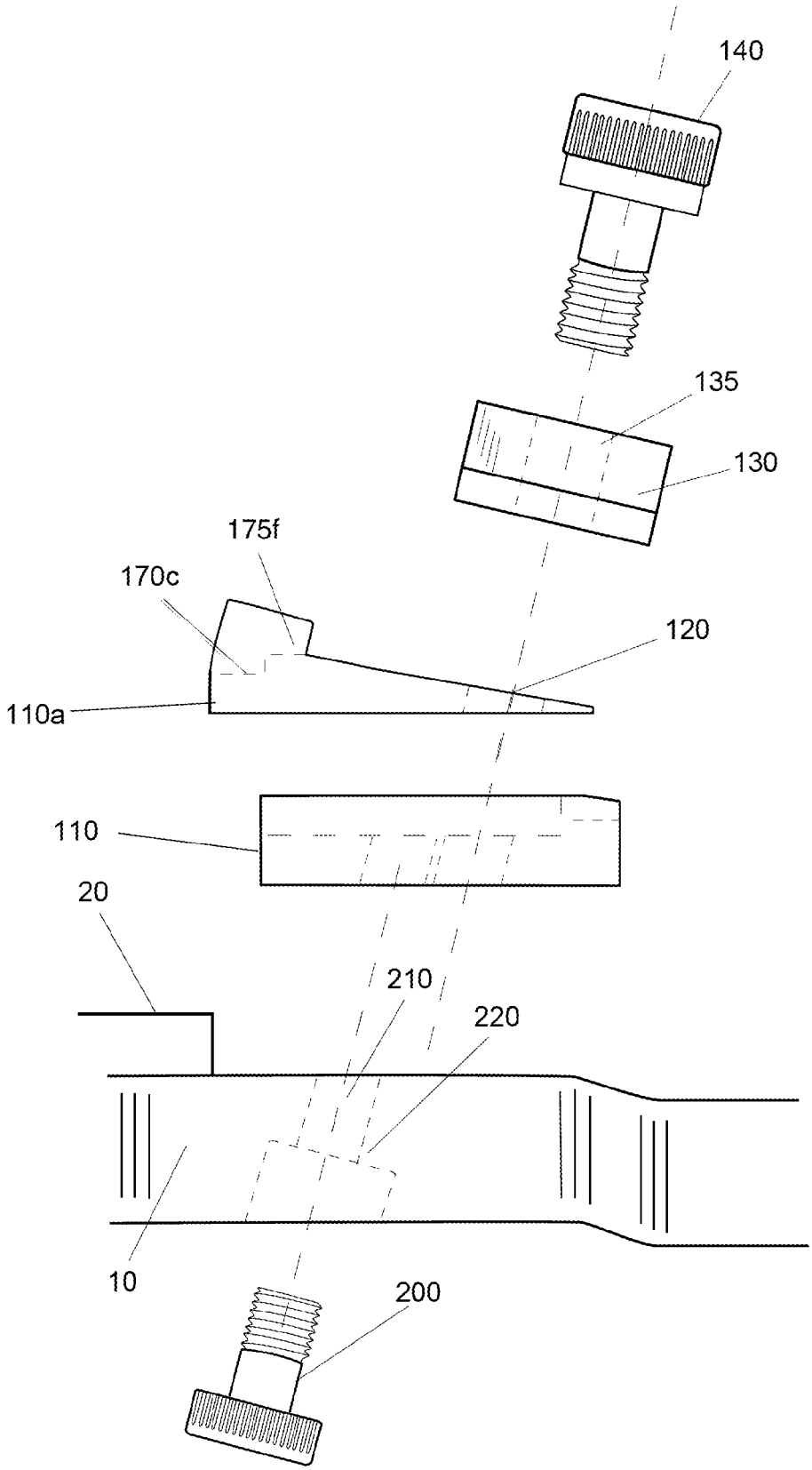
FIG. 2F depicts one embodiment of an exploded side view of the installation of a locking compensated nut, which includes a modular, interchangeable insert member with an extended shelf, on a guitar neck with a pre-existing, standard-sized nut-receiving cutout on the guitar neck.

In FIG. 2F, an exploded side view of the present device is shown. Dashed lines 170*c* and 175*f* illustrate the configuration of string intonation cutouts 170 and intonated string-nut fulcrums 175. By slipping string-locking-plate bolt 140 through string-locking-plate slip-fit through hole 135 of string-locking-plate 130, aligning it with string-locking-plate threaded hole 150 and rotating it until the bottom surface of the head of string-locking-plate bolt 140 is in contact with the top of string-locking-plate 130 and the threads of string-locking-plate bolts 140 are securely torqued against the complementary mating threads of string-locking-plate threaded holes 150 by means of a wrench, each string will be compressed and rigidly held in position between the fixed surface at the bottom of s string-locking-plate channel 120 and the bottom face of string lock 130, thereby providing for an improvement in string tension stability especially when used in combination with a vibrato mechanism. Common vibrato mechanisms comprise a lockable floating vibrato bridge and arm assembly, similar to those discussed in U.S. Pat. No. 4,638,711 to Stroh and in U.S. Pat. No. 5,311,804 to Wilkinson, for example.

Figure 2G:
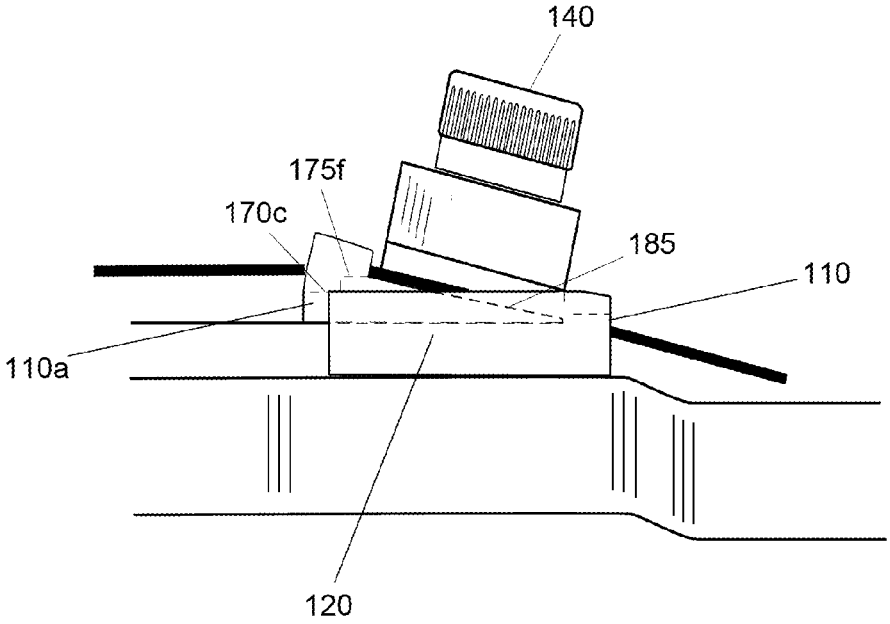
FIG. 2G depicts one embodiment of a side view of the fully installed locking compensated nut, the nut comprising a modular, interchangeable insert.

FIG. 2G illustrates an assembled side view of the present device, with an extended shelf 110*a*. As can be seen by the dashed line 170*c*, string intonation cutout 170 provides relief below string 60, and the bottom of string 60 is in contact with intonated string-nut fulcrum illustrated by dashed line 175*f*. It can also be seen that the depth of string intonation cutout 170 determines the linear position of the front of intonated string-nut fulcrum 175, and therefore the amount of intonation provided to each string 60. The locking feature of the present device is also clearly indicated. As is seen, a portion of each string 60 is rigidly compressed between the bottom of string-locking-plate channel 120 and the bottom of string-locking plate 130.

Figure 2H:
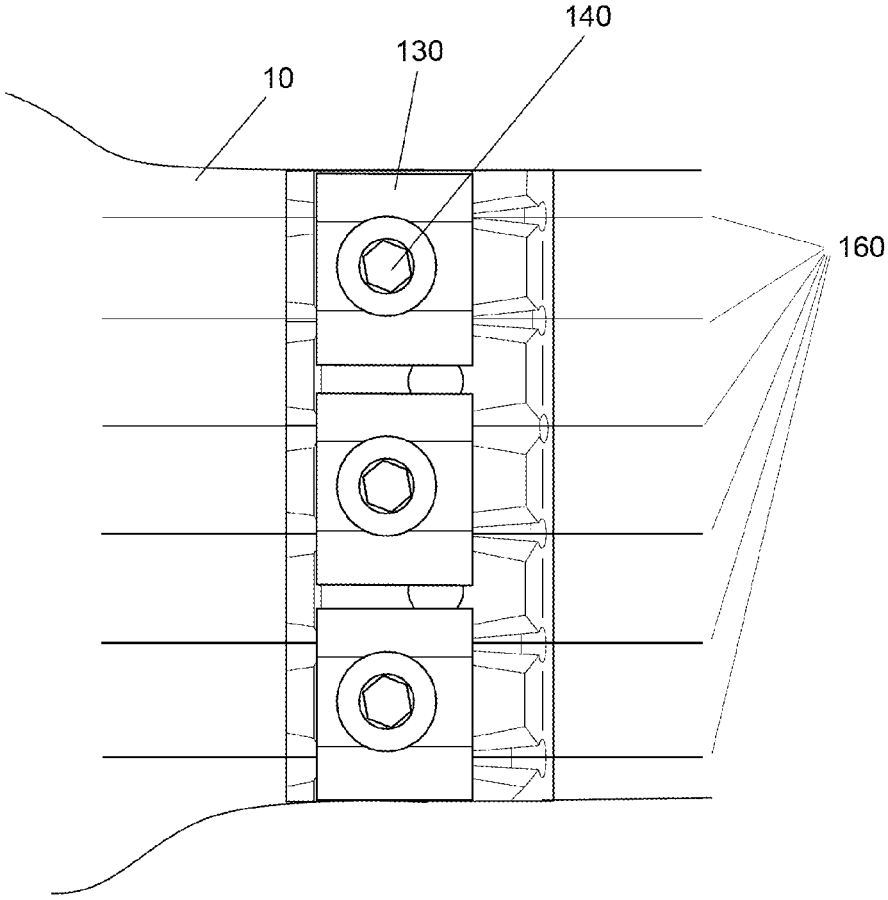
FIG. 2H depicts one embodiment of a top view of the fully installed locking compensated nut, the nut comprising a modular, interchangeable insert.
Figure 3A:
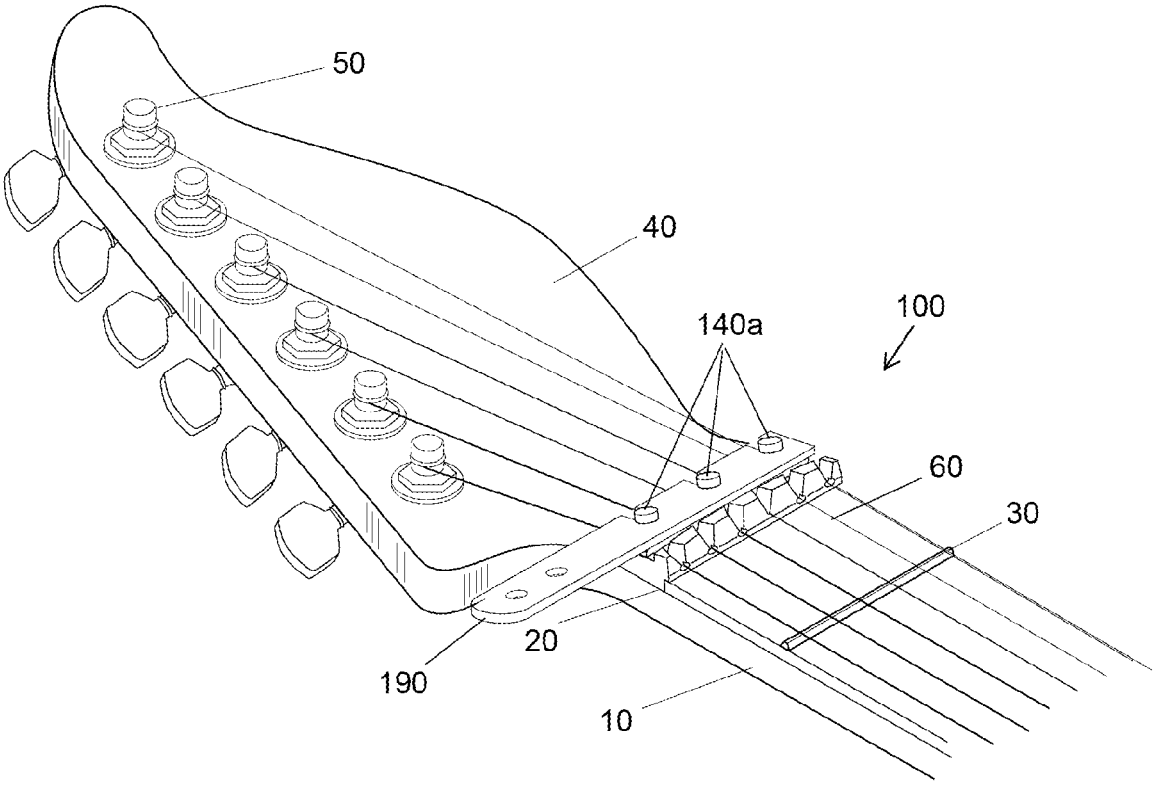
FIG. 3A depicts one embodiment of an isometric view of a locking compensated nut installed on the neck of a guitar, wherein lock-down fasteners are specially adapted to receive a tuner-mount bar, which is shown installed.
Figure 3B:
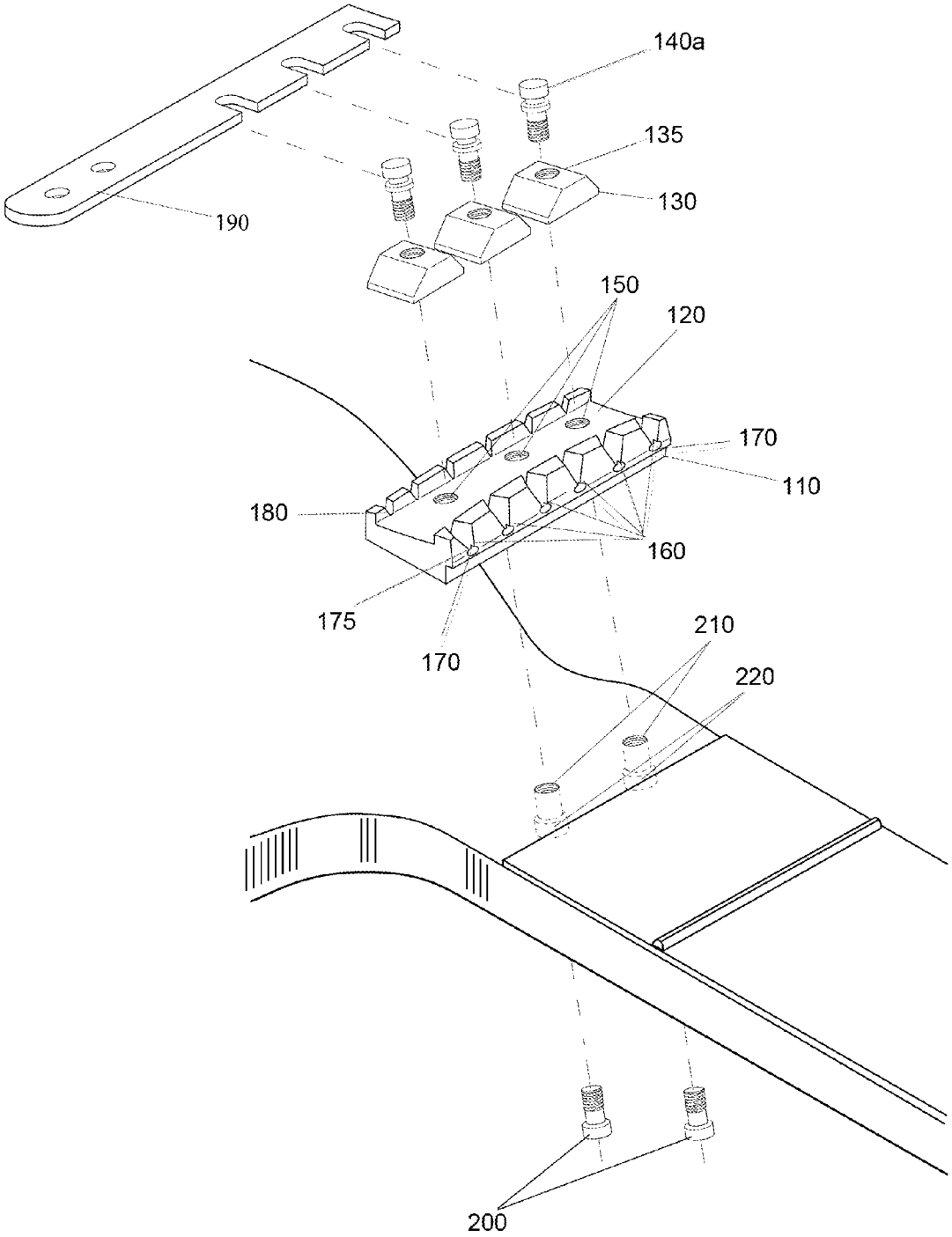
FIG. 3B depicts an exploded isometric view of one embodiment of locking compensated nut installed on the neck of a guitar, wherein lock-down fasteners are specially adapted to receive a tuner-mount bar, which is shown installed.
Figure 3C:
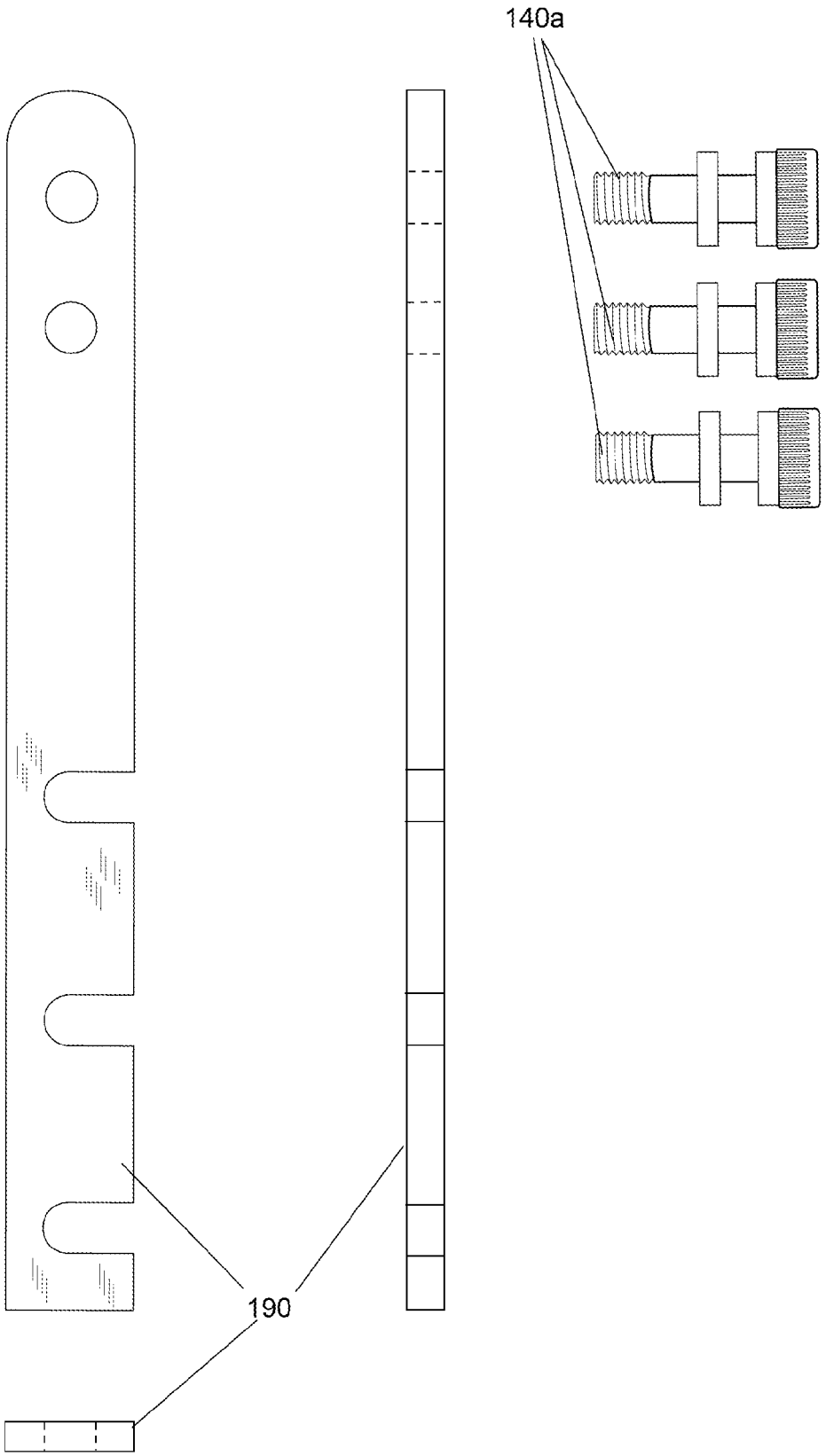
FIG. 3C depicts one embodiment of a tuner bar for mounting on a locking nut for a guitar. Shown are top, side, and end views of the tuner bar. Also shown are two specialized locking-nut fasteners, each of which has two flanges, the fastener head and a lower flange spaced such that it can receive a tuner bar engagement slot via interference fit.
Figure 3D:
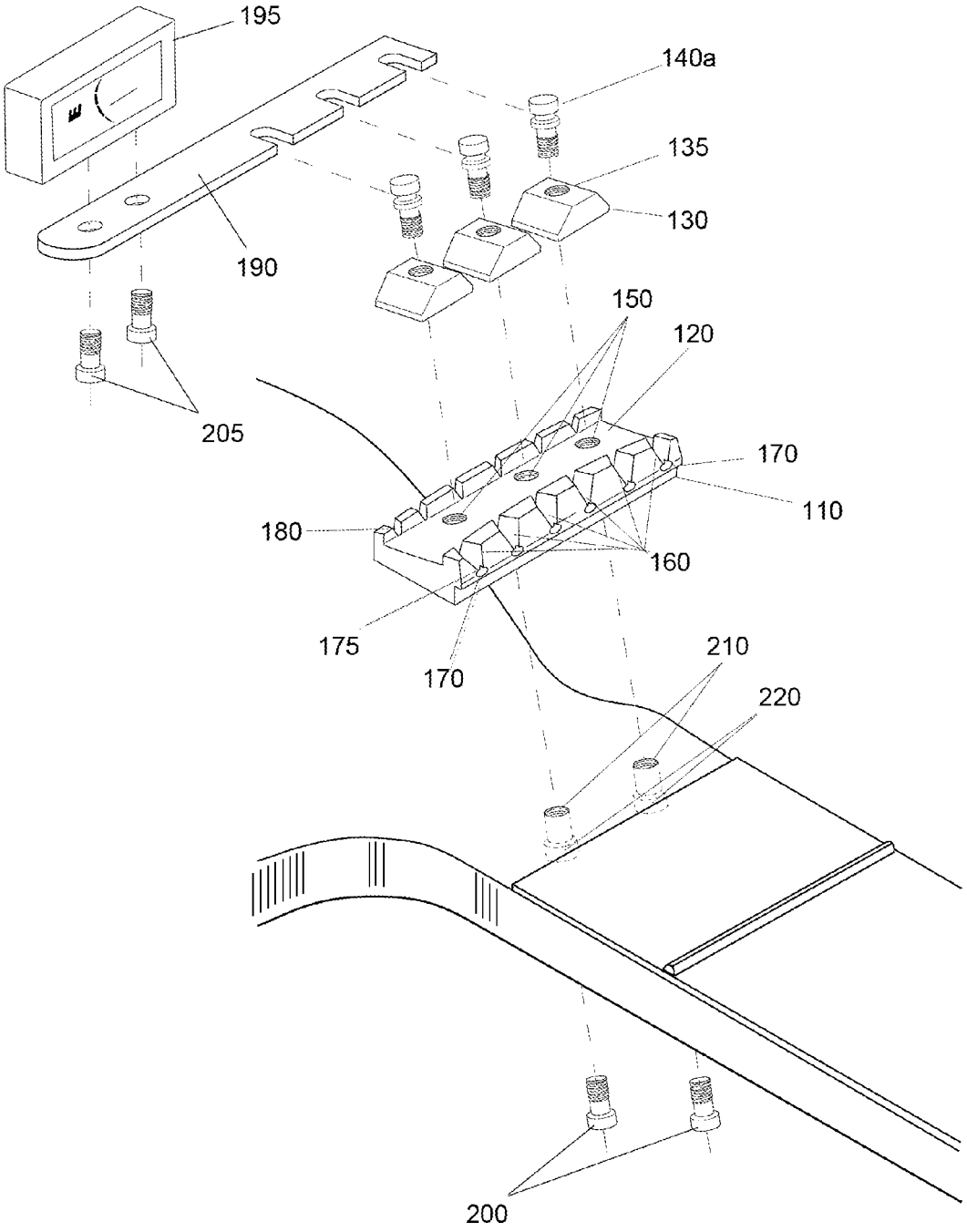
FIG. 3D depicts an exploded isometric view of one embodiment of locking compensated nut installed on the neck of a guitar, wherein lock-down fasteners are specially adapted to receive a tuner-mount bar, which is shown installed. Also shown is an example tuner that can be installed onto the tuner bar via threaded fasteners.
Figure 3E:
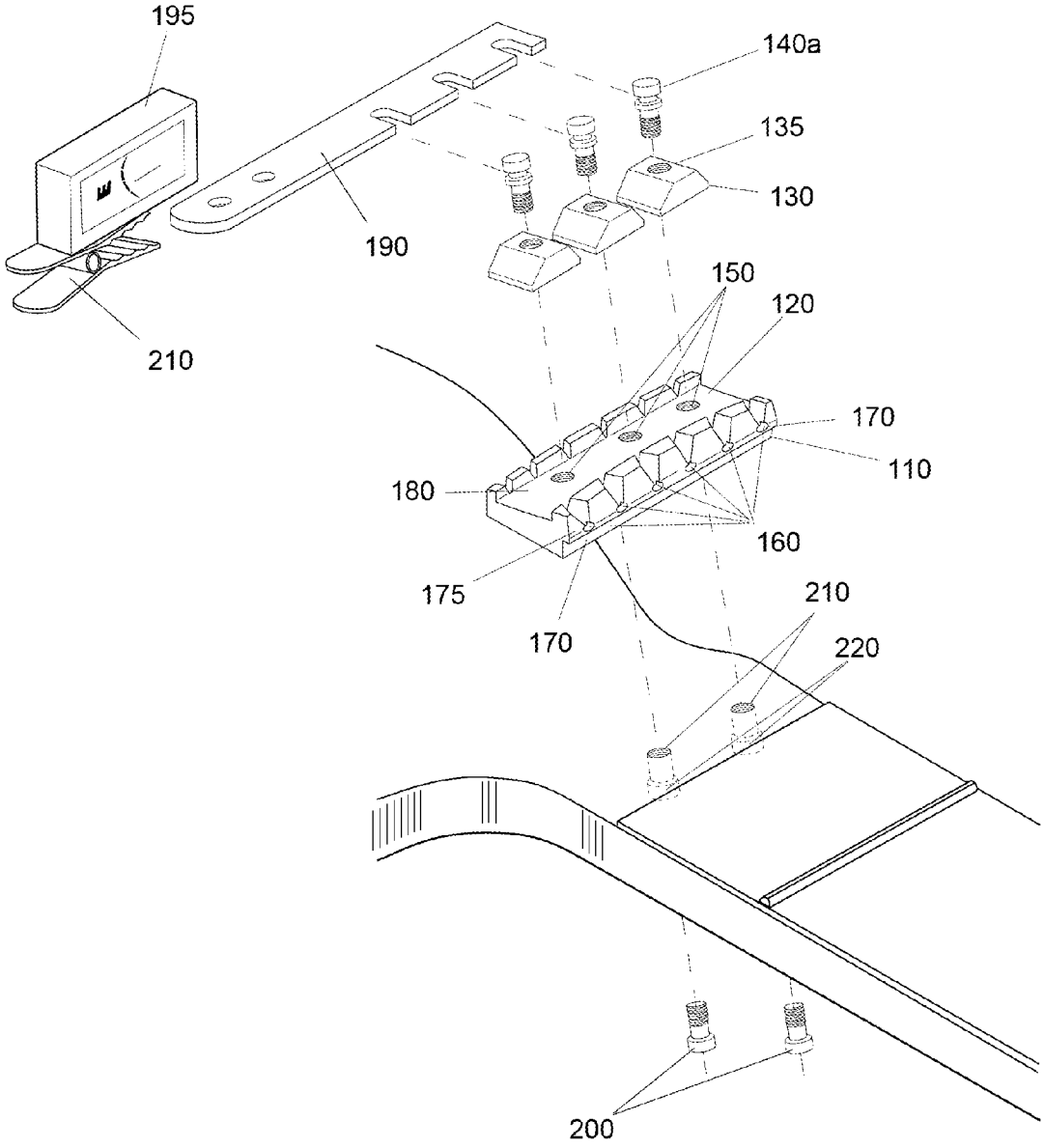
FIG. 3E depicts an exploded isometric view of one embodiment of locking compensated nut installed on the neck of a guitar, wherein lock-down fasteners are specially adapted to receive a tuner-mount bar, which is shown installed. Also shown is an example tuner that can be installed onto the tuner bar via a spring-loaded clamp.
Figure 4A:
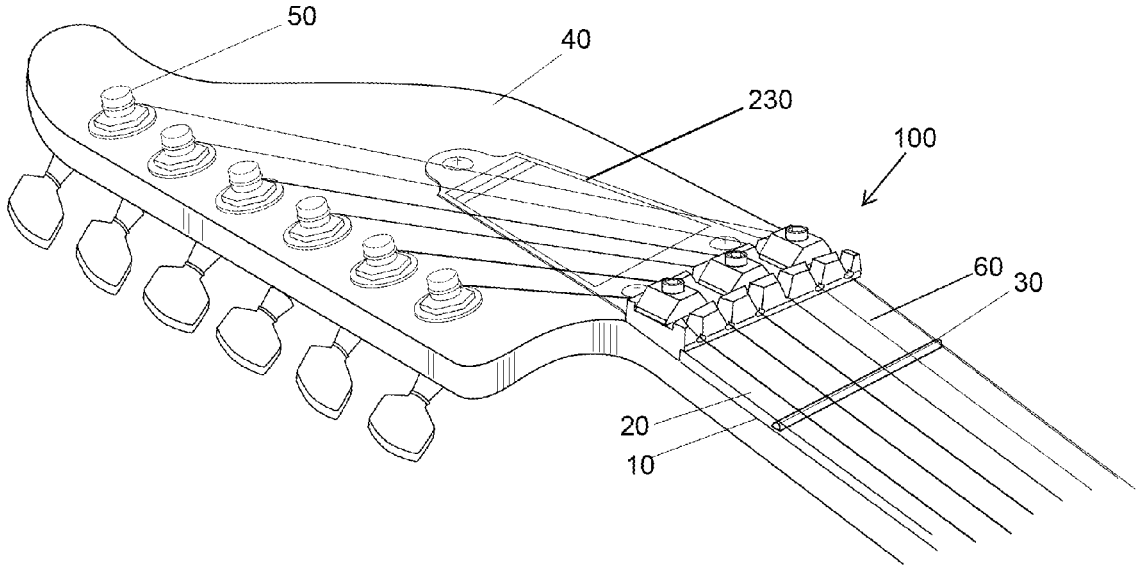
FIG. 4A depicts one specialized embodiment of an isometric view of a locking compensated nut installed on the neck of a guitar, wherein the base of the locking nut includes an angled extension and label plate fastened to the headstock.
Figure 4B:
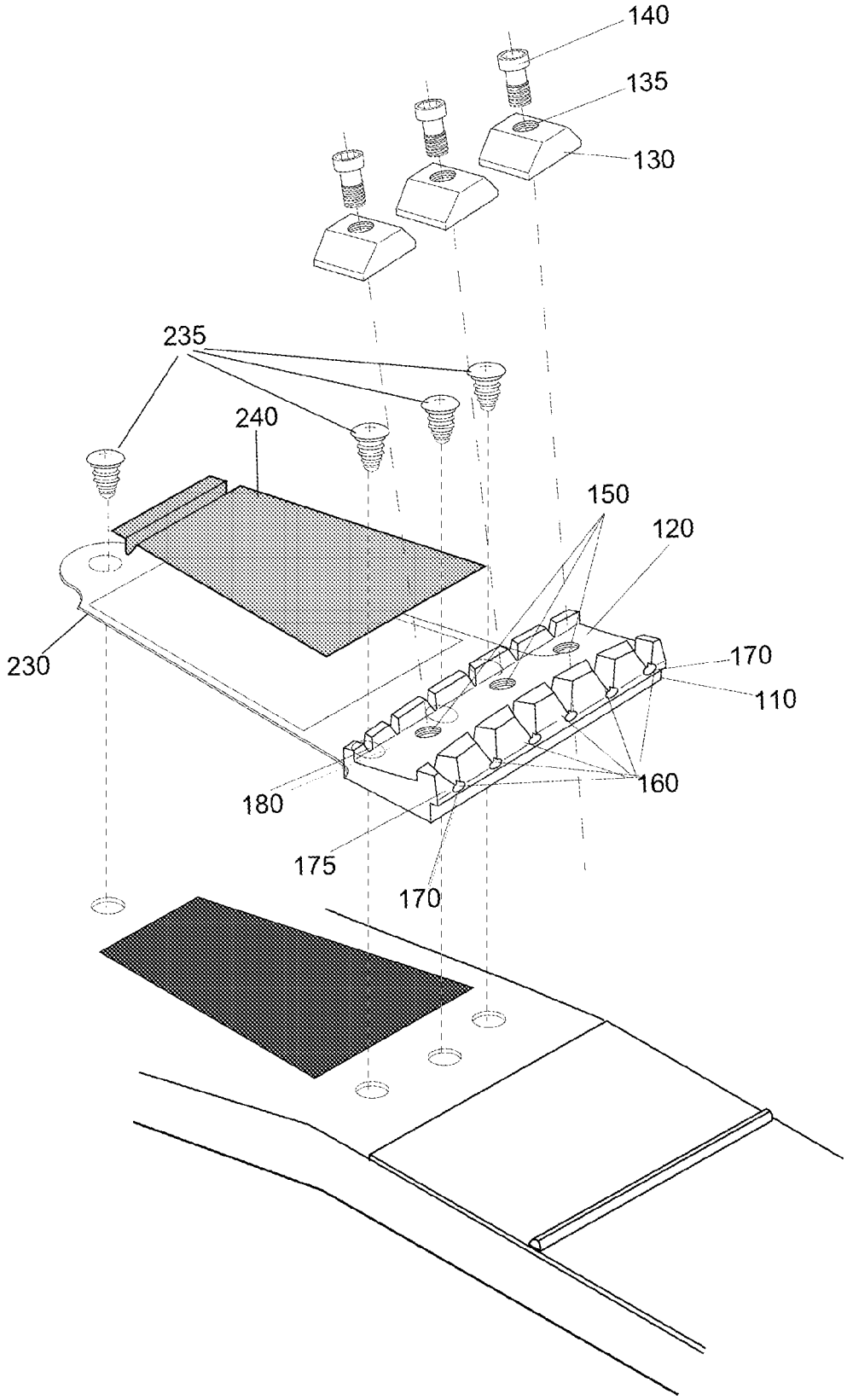
FIG. 4B depicts an exploded isometric view of one specialized embodiment of a locking compensated nut installed on the neck of a guitar, wherein the base of the locking nut includes an angled extension and label plate fastened to the headstock.
Figure 4C:
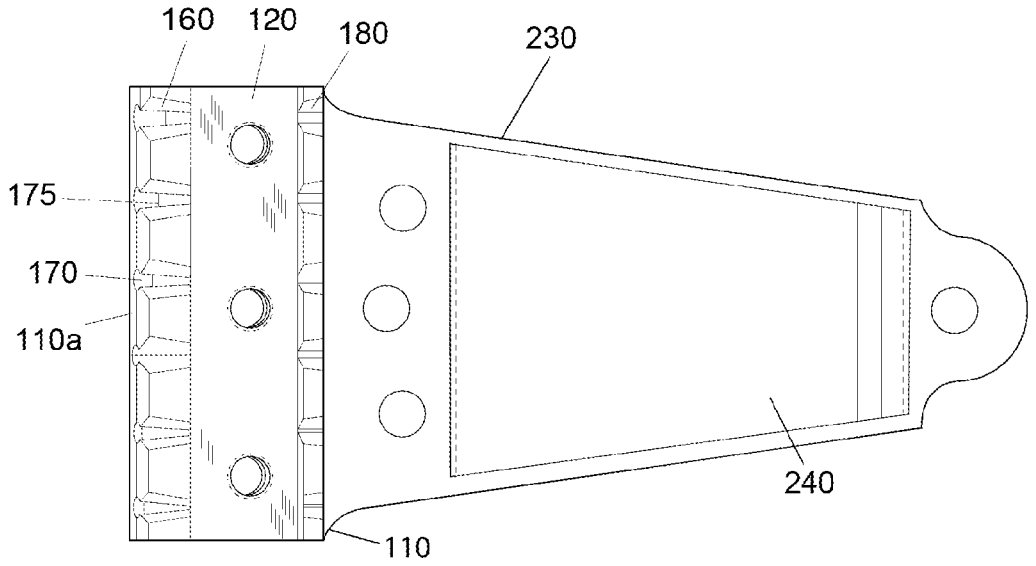
FIG. 4C depicts one embodiment of the top view of a specialized embodiment of a the base plate of a locking compensated nut, wherein the base of the locking nut includes an angled extension and label plate adapted to be fastened to a guitar headstock.
Figure 4D:
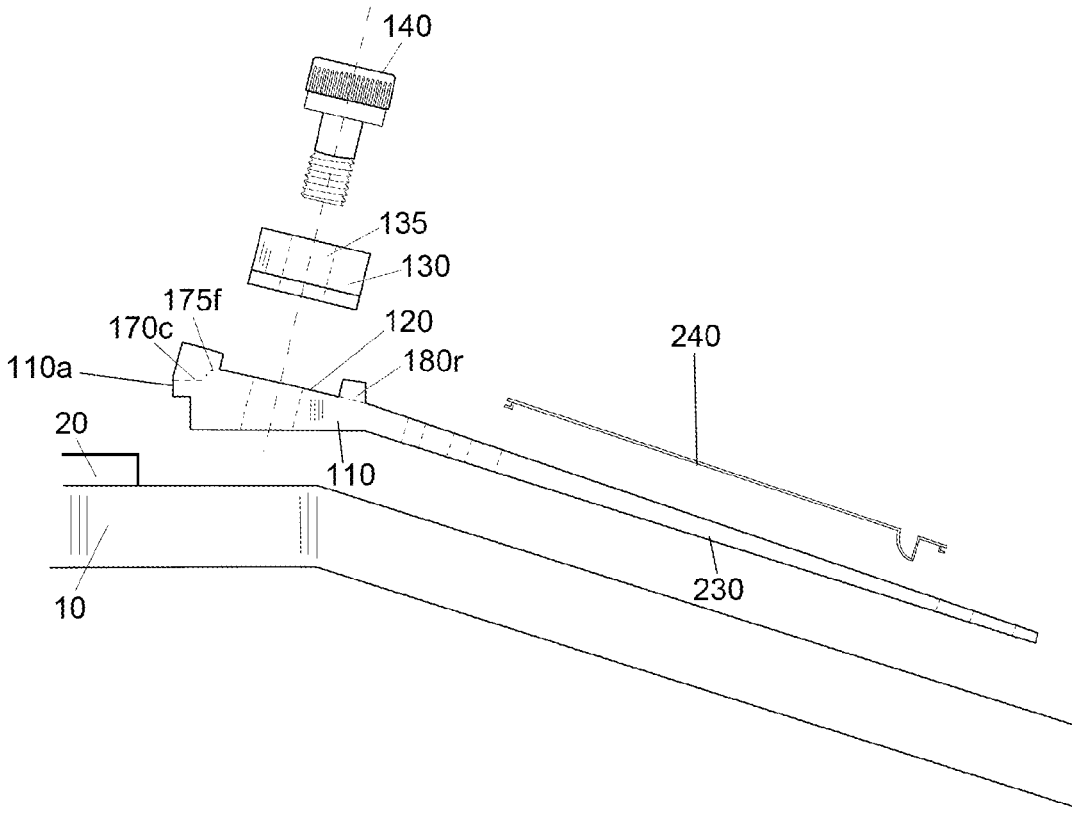
FIG. 4D depicts an exploded side view of one specialized embodiment of a locking compensated nut installed on the neck of a guitar, wherein the base of the locking nut includes an angled extension and label plate fastened to the headstock.
Figure 4E:
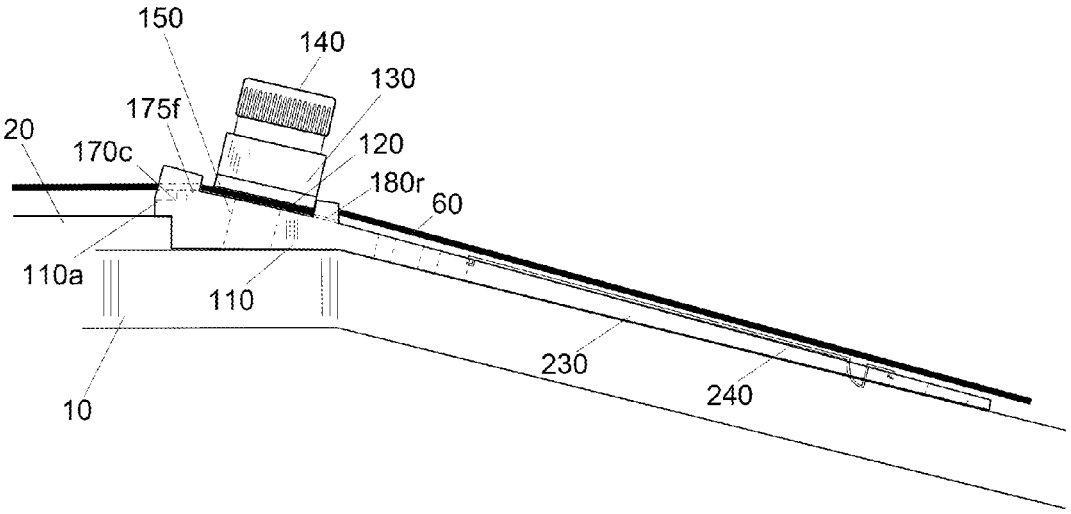
FIG. 4E depicts a fully installed side view of one specialized embodiment of a locking compensated nut installed on the neck of a guitar, wherein the base of the locking nut includes an angled extension and label plate fastened to the headstock.
Figure 4F:
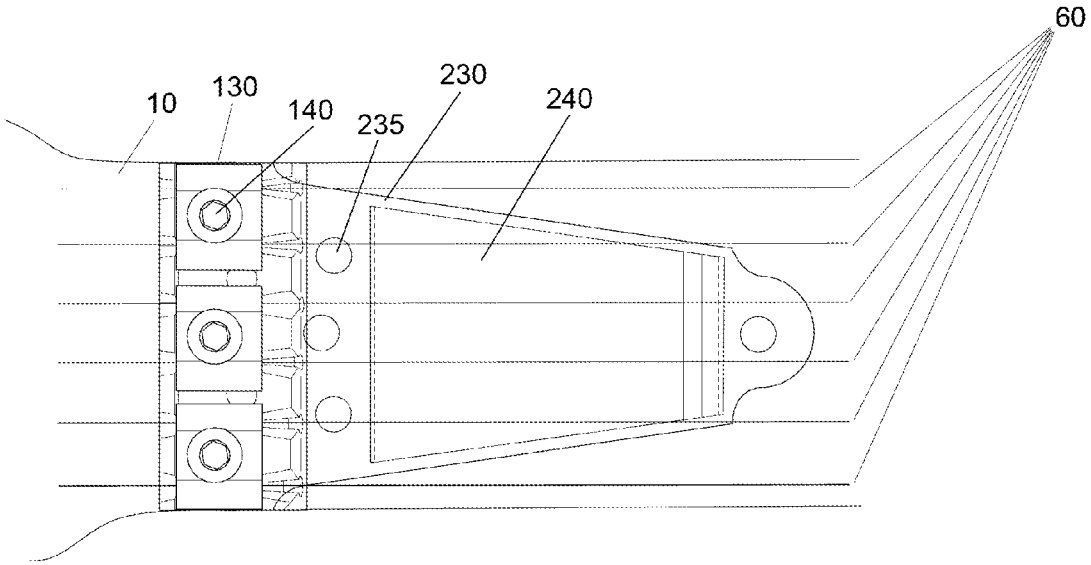
FIG. 4F depicts one embodiment of a top view of the fully installed locking compensated nut, the nut including an elongated and angled label-plate extension that is disposed on the guitar headstock.

A top view of the present device fully assembled is seen in FIG. 2H. As is clearly seen, each string is provided a specific amount of compensation, and each is rigidly locked into linear position by means of compressing each string between a fixed surface and a variable height surface.

Variations of the embodiments described in this Section IV can be implemented with the teachings of FIGS. 4A-4F, in which the base 110 may include an elongated and angled extended section 230 to accommodate some guitar manufacturer's specialized label-plate/ornamentation needs. For example, many Gibson® guitars typically have such an extension from the guitar's string nut. FIGS. 4A-4F depict the angled extension 230 disposed onto the headstock 40 of a guitar. In variations, an overlaid label plate 240 is fixedly coupled onto the extension 230. The extension 230 and label plate 240 (if included) are typically secured to the headstock 40 via threaded fasteners 235. Regardless, of the presence of such extensions, for purposes of interpreting the claims in this disclosure, the rear position of the base 110 at which rear elongated v-shaped string guides 180 may be disposed is considered to be roughly at the point the extension member 230 begins and angles away from the main plane of the base 110.

V. An Intonated Locking Nut Adapted to Receive a Tuner-Mount Bar

Refer to FIGS. 3A-3E. This Section V is generally directed to a locking-nut tuner-mount bar 190 for detachable coupling to a locking nut 100 (for example, the locking nuts described in Sections III and IV, supra) on a guitar (or similar stringed instrument), wherein said tuner-mount bar 190 is slidably engaged by interference fit to a plurality of specialized locking-nut fasteners 140*a*. This configuration allows the tuner-mount bar to be in immediate vibrational communication with the strings 60 at the nut 100. This, in turn, allows for the mounting of a tuner device 195 onto said tuner-mount bar 190 (via either threaded fasteners 205 or a clamp-type device 210), this making said tuner device 195 to also be in the same vibrational communication as the tuner-mount bar 190. The goal is to increase the fidelity of the sound/vibrations realized at the tuner device 195 in order to improve the effectiveness of tuning operations. (Prior-art devices require that such tuner devices be clamped/mounted on the headstock of a guitar, leading to distortion due to attenuation of the vibrations by the headstock materials/wood.)

The examples in FIGS. 3A-3E depict an embodiment using a compensated locking nut; however, one ordinarily skilled in the art will immediately appreciate the fact that the tuner-mount-bar components 190, 140 can be applied to any uncompensated locking nut as well by changing-out the existing string-locking fasteners with dual-flange fasteners 140*a* that are adapted to detachably couple with a tuner-mount bar 190. For example, it is anticipated that a retrofit kit can be made available to users to exchange the string-nut-locking fasteners of an existing stringed musical instrument with dual-flanged fasteners 140*a* so that a user can removably install a properly sized tuner-mount bar 190 as desired.

On a locking nut 100, the locking fasteners 140*a* used are specialized in that they are dual-flange fasteners 140*a* with a gap between the fastener head and the second fastener flange that is sized to slidably receive a tuner-mount bar 190 via interference fit that is snug-enough to ensure that at least one side of tuner-mount bar 190 is in direct, metal-to-metal contact with the locking nut fasteners 140*a*. In variations, the fasteners 140*a* can have one washer/gasket member (not shown) with elastic properties to help facilitate a snug-yet-detachable coupling with a tuner-mount bar 190. Alternatively, metal conical washers or spring washers can be used to help create a snug, detachable coupling between the upper shafts of the fasteners 140*a* and the tuner-mount bar 190.

Ideally, the tuner-mount bar 190 is made of hardened steel, titanium, or similar hardened metal to ensure good vibration conduction to a mounted tuner device 195.

Variations of the embodiments described in this Section V can be implemented with the teachings of FIGS. 4A-4F, in which the base 110 may include an elongated and angled extended section 230 to accommodate some guitar manufacturer's specialized label-plate/ornamentation needs. For example, many Gibson® guitars typically have such an extension from the guitar's string nut. FIGS. 4A-4F depict the angled extension 230 disposed onto the headstock 40 of a guitar. In variations, an overlaid label plate 240 is fixedly coupled onto the extension 230. The extension 230 and label plate 240 (if included) are typically secured to the headstock 40 via threaded fasteners 235. Regardless, of the presence of such extensions, for purposes of interpreting the claims in this disclosure, the rear position of the base 110 at which rear elongated v-shaped string guides 180 may be disposed is considered to be roughly at the point the extension member 230 begins and angles away from the main plane of the base 110.

VI. An Intonated Locking Nut for Retrofitting in a Stringed Musical Instrument This Section VI is generally directed to an improved locking compensated nut for fretted stringed musical instruments with other variations thereof similar to those discussed in U.S. Pat. No. 8,354,578 (for "Intonated string nut With Locking Mechanism for Musical Instruments and Methods of Use"), U.S. Pat. No. 8,153,873 (for "Intonated string nut With Locking Mechanism for Musical Instruments and Methods of Use"), and U.S. Pat. No. 7,750,217 (for "Intonated string nut With Locking Mechanism for Musical String Instruments").

Refer to FIGS. 1A-1G; 2A-2H; 3A-3E; and 4A-4F. In an embodiment, the improved intonated string nut 100 is adapted for retrofitting a musical string instrument. The improved intonated string nut 100 with string-locking mechanism comprises a compensation fulcrum 175 for each individual string 60, wherein each compensation fulcrum 175 is disposed on a base 110 of a predetermined size to correspondingly fit into an existing stringed musical instrument's nut-receiving cutout 20, each compensation fulcrum 175 is positioned at a varying depth relative to a front face of the combination intonated string nut with string locking mechanism 100 in order to provide the ideal amount of linear compensation for each of the strings 60, each compensation fulcrum 175 has a varying linear position in relation to each individual string 60 in order to optimize the compensation amount for the musical notes produced for each said individual string 60 when each individual string is caused to vibrate between a bridge fulcrum and said compensation fulcrum, and each compensation fulcrum 175 is disposed on a protruding front shelf 110*a* above the base 110. The shelf 110*a* extends past the associated stringed musical instrument's pre-existing nut-receiving cutout 20 by a predetermined length, which allows the improved intonated string nut 100 to be disposed within the stringed musical instrument's pre-existing nut-receiving cutout 20 while still being long-enough to provide effective tuning compensation. As a result of the optimum compensation, the musical notes produced will be in tune relative to each other when each individual string 60 is caused to vibrate between the bridge fulcrum 175 and any one of a plurality of fret fulcrums 30.

In embodiments, the improved intonated string nut 100 also comprises a string locking means 130, wherein the string locking means 130 provides a rigid linear position securability of each individual string 60 at each compensation fulcrum 175 by means of compressing each individual string 60 between a first rigid surface with a fixed position and a second rigid surface that is height-adjustable and position-lockable.

In variations, the improved intonated string nut 100 also comprises a string-positioning mechanism 160, 180 for each string 60. In more variations, the string-positioning mechanism 160, 180 comprises a first v-shaped string guidance channel 160 located at a front face of the improved intonated string nut 100 and a second v-shaped string guidance channel 180 located at a rear face of the improved intonated string nut 100. In most cases, the first v-shaped string guidance channel 160 and the second v-shaped string guidance channel 180 are separated by a distance, whereby the surface area 120 between the first and second string-guidance channels 160, 180 is used with the string-locking mechanism 130 to compress the strings 60. That is, the first rigid surface with a fixed position is located between the first v-shaped string guidance channel 160 and the second v-shaped string guidance channel 180. In some embodiments, the second rigid surface 130 is a bottom surface of a height-adjustable and position-securable rigid plate-like means 130. In variations, the height-adjustable and position-securable rigid plate-like means 130 includes a through hole 135. In still more variations, the height-adjustable and position-securable rigid plate-like means 130 slip-fits between the first v-shaped string guidance channel 160 and the second v-shaped guidance channel 180, and above the first rigid surface 120. In additional variations, the height-adjustable and position-securable rigid plate-like means 130 provides position securability for one or more of the strings 60.

In more embodiments, the base 110 of the improved intonated string nut 100 includes one or more thread holes 150 for attachment to a stringed musical instrument. In variations, the base 110 of the improved intonated string nut 100 includes one or more thread holes 135 for the position-height adjustability and securability, which are achieved by means of a threaded fastener 140 used in combination with the through hole 135, one or more thread holes 150, and a torquing tool.

In still more embodiments, the base 110 of the improved intonated string nut 100 is adapted to receive a modular, interchangeable insert 185, wherein the modular, interchangeable insert 185 comprises the aforementioned protruding front shelf 110*a* and each compensation fulcrum 175, and wherein different compensation schema and/or different string-nut radius schema supported by a given modular, interchangeable insert 185 can be selected and installed by a user for a user's instrument/string set. In many variations, the modular, interchangeable insert 185 further comprises a string-positioning mechanism for each of said strings, which can include a first v-shaped string guidance channel 160 located at a front face of said modular, interchangeable insert 185, wherein a second v-shaped string guidance channel 180 is still disposed at the rear face of the base 110. In even more variations, the first v-shaped string guidance channel 160 and the second v-shaped string guidance channel 180 are separated by a distance when the modular, interchangeable insert 185 is installed onto the base 110, whereby the surface area 120 between the first and second string-guidance channels 160, 180 is used with the string-locking mechanism 130 to compress the strings 60. That is, the first rigid surface with a fixed position is located between the first v-shaped string guidance channel 160 and the second v-shaped string guidance channel 180. In some embodiments, the second rigid surface 130 is a bottom surface of a height-adjustable and position-securable rigid plate-like means 130. In variations, the height-adjustable and position-securable rigid plate-like means 130 includes a through hole 135. In still more variations, the height-adjustable and position-securable rigid plate-like means 130 slip-fits between the first v-shaped string guidance channel 160 and the second v-shaped guidance channel 180, and above the first rigid surface 120, which is disposed on the upper surface on the modular, interchangeable insert 185. In additional variations, the height-adjustable and position-securable rigid plate-like means 130 provides position securability for one or more of the strings 60.

In some embodiments, the base 110 and insert 185 of the improved intonated string nut 100 includes one or more thread holes 155 for attachment to a stringed musical instrument. In variations, the base 110 includes one or more thread holes for said position-height adjustability and securability, which are achieved by means of a threaded fastener used in combination with said through hole, one of said one or more thread holes, and a torquing tool.

In other embodiments, the improved intonated string nut 100 further comprises a means to mount 190 a tuner 195 for attachment to a stringed musical instrument for enhanced vibrational communication with the intonated string nut 100 and any position-locked strings 60. In variations, the tuner-mount means 190 comprises a tuner-mount bar 190 having one or more cutouts adapted to slidably, snuggly, and detachably engage with the upper shafts of one or more dual-flange fasteners 140*a*, which are also used as the threaded fasteners 140*a* for the position-height adjustability and securability of the improved intonated string nut 100. In variations, each at least one dual-flange fastener 140*a* has a gap between the fastener head and the second fastener flange, and the gap is sized to detachably couple with a tuner-mount bar 190 via interference fit that is snug-enough to ensure that at least one side of the tuner-mount bar 190 is in direct, metal-to-metal contact with at least one dual-flange fastener 140*a*. In additional embodiments, the tuner-mount bar 190 is adapted to allow a user-supplied tuner 195 to be mounted via one or more threaded fasteners 205. Alternatively, in other embodiments, the tuner-mount bar 190 is adapted to allow a user-supplied tuner to be mounted via a clamping device 210. In variations, the tuner-mount bar 190 is substantially comprised of a material selected from the group consisting of hardened steel and titanium. In other variations, the one or more dual-flange fasteners 140*a* are substantially comprised of a material selected from the group consisting of hardened steel and titanium. In even more variations, each of the one or more dual-flange fasteners 140*a* are equipped with one or more metal conical washers (not shown) or spring washers (not shown) to help create a snug, detachable coupling between the upper shafts of the dual-flange fasteners 140*a* and the tuner-mount bar 190. Alternatively, in still more variations, each of the one or more dual-flange fasteners 140*a* are equipped with an elastic gasket member (not shown) to help create a snug, detachable coupling between the upper shafts of the dual-flange fasteners 140*a* and the tuner-mount bar 190. Importantly, however, the use of non-metallic gasket members should be limited to application to either the upper or lower surface of the tuner-mount bar 190 in order to still be able to obtain a good metal-to-metal contact between the double-flange fasteners 140*a* and the tuner-mount bar 190 to ensure good vibrational communication.

Variations of the embodiments described in this Section VI can be implemented with the teachings of FIGS. 4A-4F, in which the base 110 may include an elongated and angled extended section 230 to accommodate some guitar manufacturer's specialized label-plate/ornamentation needs. For example, many Gibson® guitars typically have such an extension from the guitar's string nut. FIGS. 4A-4F depict the angled extension 230 disposed onto the headstock 40 of a guitar. In variations, an overlaid label plate 240 is fixedly coupled onto the extension 230. The extension 230 and label plate 240 (if included) are typically secured to the headstock 40 via threaded fasteners 235. Regardless, of the presence of such extensions, for purposes of interpreting the claims in this disclosure, the rear position of the base 110 at which rear elongated v-shaped string guides 180 may be disposed is considered to be roughly at the point the extension member 230 begins and angles away from the main plane of the base 110.

VII. A Method of Making an Intonated Locking Nut for Retrofitting in a Stringed Musical Instrument This Section VII is generally directed to a method of making an improved locking compensated nut for fretted stringed musical instruments with other variations thereof similar to those discussed in U.S. Pat. No. 8,354,578 (for "Intonated string nut With Locking Mechanism for Musical Instruments and Methods of Use"), U.S. Pat. No. 8,153,873 (for "Intonated string nut With Locking Mechanism for Musical Instruments and Methods of Use"), and U.S. Pat. No. 7,750,217 (for "Intonated string nut With Locking Mechanism for Musical String Instruments").

Refer to FIGS. 1A-1G; 2A-211; 3A-3E; and 4A-4F. In an embodiment, the method comprises the steps of:

Providing a compensation fulcrum 175 for each individual string 60, wherein each compensation fulcrum 175 is disposed on a base 110 of a predetermined size to correspondingly fit into an existing stringed musical instrument's nut-receiving cutout 20, each compensation fulcrum 175 is positioned at a varying depth relative to a front face of the combination intonated string nut with string locking mechanism 100 in order to provide the ideal amount of linear compensation for each of the strings 60, each compensation fulcrum 175 has a varying linear position in relation to each individual string 60 in order to optimize the compensation amount for the musical notes produced for each said individual string 60 when each individual string is caused to vibrate between a bridge fulcrum and said compensation fulcrum, and each compensation fulcrum 175 is disposed on a protruding front shelf 110*a* above the base 110. The shelf 110*a* extends past the associated stringed musical instrument's pre-existing nut-receiving cutout 20 by a predetermined length, which allows the improved intonated string nut 100 to be disposed within the stringed musical instrument's pre-existing nut-receiving cutout 20 while still being long-enough to provide effective tuning compensation. As a result of the optimum compensation, the musical notes produced will be in tune relative to each other when each individual string 60 is caused to vibrate between the bridge fulcrum 175 and any one of a plurality of fret fulcrums 30; and Providing a string locking means 130, wherein the string locking means 130 provides a rigid linear position securability of each individual string 60 at each compensation fulcrum 175 by means of compressing each individual string 60 between a first rigid surface with a fixed position and a second rigid surface that is height-adjustable and position-lockable.

The method can be enhanced by further comprising the step of providing a string-positioning mechanism 160, 180 for each string 60. In more variations, the string-positioning mechanism 160, 180 comprises a first v-shaped string guidance channel 160 located at a front face of the improved intonated string nut 100 and a second v-shaped string guidance channel 180 located at a rear face of the improved intonated string nut 100. In most cases, the first v-shaped string guidance channel 160 and the second v-shaped string guidance channel 180 are separated by a distance, whereby the surface area 120 between the first and second string-guidance channels 160, 180 is used with the string-locking mechanism 130 to compress the strings 60. That is, the first rigid surface with a fixed position is located between the first v-shaped string guidance channel 160 and the second v-shaped string guidance channel 180. In some embodiments, the second rigid surface 130 is a bottom surface of a height-adjustable and position-securable rigid plate-like means 130. In variations, the height-adjustable and position-securable rigid plate-like means 130 includes a through hole 135. In still more variations, the height-adjustable and position-securable rigid plate-like means 130 slip-fits between the first v-shaped string guidance channel 160 and the second v-shaped guidance channel 180, and above the first rigid surface 120. In additional variations, the height-adjustable and position-securable rigid plate-like means 130 provides position securability for one or more of the strings 60.

In more embodiments, the base 110 of the improved intonated string nut 100 includes one or more thread holes 150 for attachment to a stringed musical instrument. In variations, the base 110 of the improved intonated string nut 100 includes one or more thread holes 135 for the position-height adjustability and securability, which are achieved by means of a threaded fastener 140 used in combination with the through hole 135, one or more thread holes 150, and a torquing tool.

In still more embodiments, the method further includes the steps of providing a base 110 of the improved intonated string nut 100 that is adapted to receive a modular, interchangeable insert 185, and providing a modular, interchangeable insert 185, wherein the modular, interchangeable insert 185 comprises the aforementioned protruding front shelf 110*a* and each compensation fulcrum 175, and wherein different compensation schema and/or different string-nut radius schema supported by a given modular, interchangeable insert 185 can be selected and installed by a user for a user's instrument/string set. In many variations, the modular, interchangeable insert 185 further comprises a string-positioning mechanism for each of said strings, which can include a first v-shaped string guidance channel 160 located at a front face of said modular, interchangeable insert 185, wherein a second v-shaped string guidance channel 180 is still disposed at the rear face of the base 110. In even more variations, the first v-shaped string guidance channel 160 and the second v-shaped string guidance channel 180 are separated by a distance when the modular, interchangeable insert 185 is installed onto the base 110, whereby the surface area 120 between the first and second string-guidance channels 160, 180 is used with the string-locking mechanism 130 to compress the strings 60. That is, the first rigid surface with a fixed position is located between the first v-shaped string guidance channel 160 and the second v-shaped string guidance channel 180. In some embodiments, the second rigid surface 130 is a bottom surface of a height-adjustable and position-securable rigid plate-like means 130. In variations, the height-adjustable and position-securable rigid plate-like means 130 includes a through hole 135. In still more variations, the height-adjustable and position-securable rigid plate-like means 130 slip-fits between the first v-shaped string guidance channel 160 and the second v-shaped guidance channel 180, and above the first rigid surface 120, which is disposed on the upper surface on the modular, interchangeable insert 185. In additional variations, the height-adjustable and position-securable rigid plate-like means 130 provides position securability for one or more of the strings 60.

In some embodiments, the base 110 and insert 185 of the improved intonated string nut 100 includes one or more thread holes 155 for attachment to a stringed musical instrument. In variations, the base 110 includes one or more thread holes for said position-height adjustability and securability, which are achieved by means of a threaded fastener used in combination with said through hole, one of said one or more thread holes, and a torquing tool.

In other embodiments, the method further comprises the step of providing a means to mount 190 a tuner 195 for attachment to a stringed musical instrument for enhanced vibrational communication with the intonated string nut 100 and any position-locked strings 60. In variations, the tuner-mount means 190 comprises a tuner-mount bar 190 having one or more cutouts adapted to slidably, snuggly, and detachably engage with the upper shafts of one or more dual-flange fasteners 140*a*, which are also used as the threaded fasteners 140*a* for the position-height adjustability and securability of the improved intonated string nut 100. In variations, each at least one dual-flange fastener 140*a* has a gap between the fastener head and the second fastener flange, and the gap is sized to detachably couple with a tuner-mount bar 190 via interference fit that is snug-enough to ensure that at least one side of the tuner-mount bar 190 is in direct, metal-to-metal contact with at least one dual-flange fastener 140*a*. In additional embodiments, the tuner-mount bar 190 is adapted to allow a user-supplied tuner 195 to be mounted via one or more threaded fasteners 205. Alternatively, in other embodiments, the tuner-mount bar 190 is adapted to allow a user-supplied tuner to be mounted via a clamping device 210. In variations, the tuner-mount bar 190 is substantially comprised of a material selected from the group consisting of hardened steel and titanium. In other variations, the one or more dual-flange fasteners 140*a* are substantially comprised of a material selected from the group consisting of hardened steel and titanium. In even more variations, each of the one or more dual-flange fasteners 140*a* are equipped with one or more metal conical washers (not shown) or spring washers (not shown) to help create a snug, detachable coupling between the upper shafts of the dual-flange fasteners 140*a* and the tuner-mount bar 190. Alternatively, in still more variations, each of the one or more dual-flange fasteners 140*a* are equipped with an elastic gasket member (not shown) to help create a snug, detachable coupling between the upper shafts of the dual-flange fasteners 140*a* and the tuner-mount bar 190. Importantly, however, the use of non-metallic gasket members should be limited to application to either the upper or lower surface of the tuner-mount bar 190 in order to still be able to obtain a good metal-to-metal contact between the double-flange fasteners 140*a* and the tuner-mount bar 190 to ensure good vibrational communication.

VIII. A Method of Using an Intonated Locking Nut for Retrofitting in a Stringed Musical Instrument This Section VIII is generally directed to a method of using an improved locking compensated nut for fretted stringed musical instruments pursuant to those described in Sections III, IV, V, or VI, with other variations thereof similar to those discussed in U.S. Pat. No. 8,354,578 (for "Intonated string nut With Locking Mechanism for Musical Instruments and Methods of Use"), U.S. Pat. No. 8,153,873 (for "Intonated string nut With Locking Mechanism for Musical Instruments and Methods of Use"), and U.S. Pat. No. 7,750,217 (for "Intonated string nut With Locking Mechanism for Musical String Instruments").

Refer to FIGS. 1A-1G; 2A-2H; 3A-3E; and 4A-4F. In an embodiment, the method comprises the steps of:

- Obtaining an improved intonated string 100 nut as described in Sections III, IV, V, or VI;
- Installing said improved intonated string nut 100 on the neck 10 of a target stringed musical instrument;
- Ensuring that each string 60 of the musical instrument is suspended at one end at the upper neck 10 of the musical instrument by its associated string-nut fulcrum 175;
- As necessary, adjusting each string 60 tension by its associated tuner 190 on the headstock 40 of the musical instrument;
- Ensuring that each string 60 is locked into a rigid linear position by the string-locking means 130; and
- Playing the musical instrument by causing at least one string 60 on the musical instrument to vibrate.

In additional embodiments, the method further comprises the steps of:

- Obtaining a tuner-mount bar 190 adapted for attachment to the one or more dual-flange fasteners 140*a*, wherein said a tuner-mount bar has one or more cutouts adapted to slidably, snuggly and detachably engage the tuner-mount bar 190 with the upper shafts of the one or more dual-flange fasteners 140*a;*
- Removably coupling the tuner-mount bar 190 to one or more dual-flange fasteners 140*a*, ensuring a snug fit that provides metal-to-metal contact between one or more dual-flange fasteners 140*a* and the tuner-mount bar 190;
- Selecting and detachably coupling a stringed-musical-instrument tuner device 195 to the tuner-mount bar 190; and
- Tuning the target stringed musical instrument.

IX. A Kit for Installing a Tuner-Mount Means for a Stringed Musical Instrument Refer to FIGS. 3A-3E. This Section IX is generally directed to a kit for installing an improved tuner-mount means on a stringed musical instrument that has a locking string nut, the string-locking mechanism for the improved locking string nut employing a height-adjustable and position-securable rigid plate-like means 130 to provide position securability for one or more of the strings 60 of a musical string instrument and the rigid plate-like means 130 designed to be secured in place by one or more threaded fasteners 140, 140*a*.

In an embodiment, the tuner-mount kit comprises a tuner-mount bar 190 for attachment of a stringed musical instrument tuner 195 for enhanced vibrational communication with a string nut and any position-locked strings and one or more dual-flange fasteners 140*a* that are sized and can be used as the threaded fasteners for the position-height adjustability and securability of a string nut, wherein each dual-flange fastener 140*a* has a gap between the fastener head and the second fastener flange, the gap is sized to detachably couple with a tuner-mount bar 190 via interference fit that is snug-enough to ensure that at least one side of a tuner-mount bar 190 is in direct, metal-to-metal contact with at least one dual-flange fastener, and the tuner-mount bar 190 has one or more cutouts adapted to slidably, snuggly, and detachably engage with the upper shafts of one or more dual-flange fasteners 140*a*.

In some embodiments, the tuner-mount bar 190 is adapted to allow a user-supplied tuner 195 to be mounted via one or more threaded fasteners 140*a*. In other variations, the tuner-mount bar 190 is adapted to allow a user-supplied tuner 195 to be mounted via a clamping device.

In some embodiments, the tuner-mount bar 190 is substantially comprised of a material selected from the group consisting of hardened steel and titanium. Similarly, in embodiments, the dual-flange fasteners 140*a* are substantially comprised of a material selected from the group consisting of hardened steel and titanium.

In variations, the one or more dual-flange fasteners 140*a* are equipped with one or more metal conical washers or spring washers (not shown) to help create a snug, detachable coupling between the upper shafts of the dual-flange fasteners 140*a* and the tuner-mount bar 190. In alternative variations, the one or more dual-flange fasteners 140*a* are equipped with an elastic gasket member (not shown) to help create a snug, detachable coupling between the upper shafts of the dual-flange fasteners 140*a* and the tuner-mount bar 190.

X. A Method of Using a Kit for Installing a Tuner-Mount Means for a Stringed Musical Instrument Refer to FIGS. 3A-3E. This Section X is generally directed to a method of using a kit for installing an improved tuner-mount means on a stringed musical instrument that has a locking string nut, as described in Section IX, supra.

In an embodiment, the method comprises the steps of:

Obtaining a kit for installing a tuner-mount means 190 for a locking string nut 100 on a user-selected musical string instrument, as described in Section IX; and Replacing at least one threaded fastener 140 for locking the position of a musical-instrument string with a dual-flange fastener 140*a* from the kit, and ensuring said installed dual-flange fasteners 140*a* are tightened.

In variations, the method further comprises the step of removably coupling the tuner-mount bar 190 to one or more dual-flange fasteners on said musical-string instrument, ensuring a snug fit that provides metal-to-metal contact between one or more dual-flange fasteners 140*a* and the tuner-mount bar 190.

In variations, the method further comprises the steps of:

Selecting and detachably coupling a stringed-musical-instrument tuner device to the tuner-mount bar 190; and Tuning the target stringed musical instrument.

XI. Alternative Embodiments and Other Variations

The various embodiments and variations thereof described herein or in the appended Claims and/or illustrated in the accompanying Figures are merely exemplary and are not meant to limit the scope of the inventive disclosure. It should be appreciated that numerous variations of the invention have been contemplated as would be obvious to one of ordinary skill in the art with the benefit of this disclosure.

Hence, those ordinarily skilled in the art will have no difficulty devising myriad obvious variations and improvements to the invention, all of which are intended to be encompassed within the scope of the Description, Figures, and Claims herein.

What is claimed is:

1. In combination, an improved intonated string nut with string-locking mechanism for retrofitting a musical string instrument, the improved intonated string nut comprising:

a compensation fulcrum for each individual string, wherein:

each said compensation fulcrum is disposed on a base of a predetermined size to correspondingly fit into an existing stringed musical instrument's nut-receiving cutout, each said compensation fulcrum is positioned at a varying depth relative to a front face of said combination intonated string nut with string locking mechanism in order to provide the ideal amount of linear compensation for each of said strings, each said compensation fulcrum has a varying linear position in relation to each said individual string in order to optimize the compensation amount for the musical notes produced for each said individual string when each said individual string is caused to vibrate between a bridge fulcrum and said compensation fulcrum, each said compensation fulcrum is disposed on a protruding front shelf above said base, whereby said shelf extends past the associated stringed musical instrument's pre-existing nut-receiving cutout by a predetermined length whereby said improved intonated string nut can be disposed within said stringed musical instrument's pre-existing nut-receiving cutout while still being long-enough to provide effective tuning compensation, and whereby as a result of said optimum compensation, the musical notes produced will be in tune relative to each other when each said individual string is caused to vibrate between said bridge fulcrum and any one of a plurality of fret fulcrums; and a string locking means, wherein said string locking means provides a rigid linear position securability of each said individual string at each said compensation fulcrum by means of compressing each said individual string between a first rigid surface with a fixed position and a second rigid surface that is height-adjustable and position-lockable.

2. The improved intonated string nut of claim 1, further comprising a string-positioning mechanism for each of said strings.

3. The improved intonated string nut of claim 2, wherein each said string-positioning mechanism comprises:

a first v-shaped string guidance channel located at a front face of said improved intonated string nut; and a second v-shaped string guidance channel located at a rear face of said improved intonated string nut.

4. The improved intonated string nut of claim 3, wherein said first v-shaped string guidance channel and said second v-shaped string guidance channel are separated by a distance.

5. The improved intonated string nut of claim 4, wherein said first rigid surface with a fixed position is located between said first v-shaped string guidance channel and said second v-shaped string guidance channel.

6. The improved intonated string nut of claim 1, wherein said second rigid surface is a bottom surface of a height-adjustable and position-securable rigid plate-like means.

7. The improved intonated string nut of claim 6, wherein the height-adjustable and position-securable rigid plate-like means includes a through hole.

8. The improved intonated string nut of claim 6, wherein said height-adjustable and position-securable rigid plate-like means slip-fits between said first v-shaped string guidance channel and said second v-shaped guidance channel, and above said first rigid surface.

9. The improved intonated string nut of claim 6, wherein the height-adjustable and position-securable rigid plate-like means provides position securability for one or more of said strings.

10. The improved intonated string nut of claim 1, wherein said base of said improved intonated string nut includes one or more thread holes for attachment to a stringed musical instrument.

11. The improved intonated string nut of claim 10, wherein said base of said improved intonated string nut includes one or more thread holes for said position-height adjustability and securability, which are achieved by means of a threaded fastener used in combination with said through hole, one of said one or more thread holes, and a torquing tool.

12. The improved intonated string nut of claim 1, wherein:

said base of said improved intonated string nut is adapted to receive a modular, interchangeable insert;

said modular, interchangeable insert comprises said protruding front shelf and each said compensation fulcrum; and different compensation schema and/or different string-nut radius schema supported by a given modular, interchangeable insert can be selected and installed by a user for a user's instrument/string set.

13. The improved intonated string nut of claim 12, further comprising a string-positioning mechanism for each of said strings.

14. The improved intonated string nut of claim 13, wherein each said string-positioning mechanism comprises:

a first v-shaped string guidance channel located at a front face of said modular, interchangeable insert; and a second v-shaped string guidance channel disposed at the rear face of said base.

15. The improved intonated string nut of claim 14, wherein said first v-shaped string guidance channel and said second v-shaped string guidance channel are separated by a distance when said modular, interchangeable insert is installed onto said base.

16. The improved intonated string nut of claim 15, wherein said first rigid surface with a fixed position is located on said modular, interchangeable insert and between said first v-shaped string guidance channel and said second v-shaped string guidance channel.

17. The improved intonated string nut with string-locking mechanism of claim 12, wherein said second rigid surface is a bottom surface of a height-adjustable and position-securable rigid plate-like means.

18. The improved intonated string nut of claim 17, wherein the height-adjustable and position-securable rigid plate-like means includes a through hole.

19. The improved intonated string nut of claim 17, wherein said height-adjustable and position-securable rigid plate-like means slip-fits between said first v-shaped string guidance channel and said second v-shaped guidance channel, and above said first rigid surface.

20. The improved intonated string nut of claim 17, wherein the height-adjustable and position-securable rigid plate-like means provides position securability for one or more of said strings.

21. The improved intonated string nut of claim 12, wherein said base of said improved intonated string nut includes one or more thread holes for attachment to a stringed musical instrument.

22. The improved intonated string nut of claim 21, wherein both said base and said modular, interchangeable insert of said improved intonated string nut include one or more thread holes for said position-height adjustability and securability, which are achieved by means of a threaded fastener used in combination with said through hole, one of said one or more thread holes, and a torquing tool.

23. The improved intonated string nut of claim 11 or 22, further comprising a means to mount a tuner for attachment to a stringed musical instrument for enhanced vibrational communication with said intonated string nut and any position-locked strings, said tuner-mount means comprising:

a tuner-mount bar having one or more cutouts adapted to slidably, snuggly, and detachably engage with the upper shafts of one or more dual-flange fasteners; and one or more dual-flange fasteners that are used as said threaded fasteners for said position-height adjustability and securability of said improved intonated string nut, wherein:

each said at least one dual-flange fastener has a gap between the fastener head and the second fastener flange, and said gap is sized to detachably couple with a tuner-mount bar via interference fit that is snug-enough to ensure that at least one side of said tuner-mount bar is in direct, metal-to-metal contact with said at least one dual-flange fastener.

24. The improved intonated string nut of claim 23, wherein said tuner-mount bar is adapted to allow a user-supplied tuner to be mounted via one or more threaded fasteners.

25. The improved intonated string nut of claim 23, wherein said tuner-mount bar is adapted to allow a user-supplied tuner to be mounted via a clamping device.

26. The improved intonated string nut of claim 23, wherein said tuner-mount bar is substantially comprised of a material selected from the group consisting of hardened steel and titanium.

27. The improved intonated string nut of claim 23, wherein said one or more dual-flange fasteners are substantially comprised of a material selected from the group consisting of hardened steel and titanium.

28. The improved intonated string nut of claim 23, wherein each of said one or more dual-flange fasteners are equipped with one or more metal conical washers or spring washers to help create a snug, detachable coupling between the upper shafts of said dual-flange fasteners and said tuner-mount bar.

29. The improved intonated string nut of claim 23, wherein each of said one or more dual-flange fasteners are equipped with an elastic gasket member to help create a snug, detachable coupling between the upper shafts of said dual-flange fasteners and said tuner-mount bar.

30. An improved locking string nut for a musical string instrument, the string-locking mechanism for said improved locking string nut employing a height-adjustable and position-securable rigid plate-like means to provide position securability for one or more of the strings of a musical string instrument and said rigid plate-like means designed to be secured in place by one or more threaded fasteners, the improved locking string nut for a musical string instrument comprising:

one or more dual-flange fasteners that are used as said threaded fasteners for said position-height adjustability and securability of said improved intonated string nut, wherein:

each said at least one dual-flange fastener has a gap between the fastener head and the second fastener flange, and said gap is sized to detachably couple with a tuner-mount bar via interference fit that is snug-enough to ensure that at least one side of a tuner-mount bar is in direct, metal-to-metal contact with said at least one dual-flange fastener; and a tuner-mount bar for attachment of a stringed musical instrument tuner for enhanced vibrational communication with said intonated string nut and any position-locked strings, wherein said tuner-mount bar has one or more cutouts adapted to slidably, snuggly, and detachably engage with the upper shafts of said one or more dual-flange fasteners.

31. The improved locking string nut of claim 30, wherein said tuner-mount bar is adapted to allow a user-supplied tuner to be mounted via one or more threaded fasteners.

32. The improved locking string nut of claim 30, wherein said tuner-mount bar is adapted to allow a user-supplied tuner to be mounted via a clamping device.

33. The improved locking string nut of claim 30, wherein said tuner-mount bar is substantially comprised of a material selected from the group consisting of hardened steel and titanium.

34. The improved locking string nut of claim 30, wherein said one or more dual-flange fasteners are substantially comprised of a material selected from the group consisting of hardened steel and titanium.

35. The improved locking string nut of claim 30, wherein each of said one or more dual-flange fasteners are equipped with one or more metal conical washers or spring washers to help create a snug, detachable coupling between the upper shafts of said dual-flange fasteners and said tuner-mount bar.

36. The improved locking string nut of claim 30, wherein each of said one or more dual-flange fasteners are equipped with an elastic gasket member to help create a snug, detachable coupling between the upper shafts of said dual-flange fasteners and said tuner-mount bar.

37. A kit for installing a tuner-mount means for a locking string nut for a musical string instrument, the string-locking mechanism for said improved locking string nut employing a height-adjustable and position-securable rigid plate-like means to provide position securability for one or more of the strings of a musical string instrument and said rigid plate-like means designed to be secured in place by one or more threaded fasteners, the tuner-mount kit for comprising:

a tuner-mount bar for attachment of a stringed musical instrument tuner for enhanced vibrational communication with a string nut and any position-locked strings; and one or more dual-flange fasteners that are sized and can be used as the threaded fasteners for the position-height adjustability and securability of a string nut, wherein:

each said at least one dual-flange fastener has a gap between the fastener head and the second fastener flange, said gap is sized to detachably couple with said tuner-mount bar via interference fit that is snug-enough to ensure that at least one side of a tuner-mount bar is in direct, metal-to-metal contact with said at least one dual-flange fastener, and said tuner-mount bar has one or more cutouts adapted to slidably, snuggly, and detachably engage with the upper shafts of said one or more dual-flange fasteners.

38. The kit of claim 37, wherein said tuner-mount bar is adapted to allow a user-supplied tuner to be mounted via one or more threaded fasteners.

39. The kit of claim 38, wherein said tuner-mount bar is adapted to allow a user-supplied tuner to be mounted via a clamping device.

40. The kit of claim 37, wherein said tuner-mount bar is substantially comprised of a material selected from the group consisting of hardened steel and titanium.

41. The kit of claim 37, wherein said one or more dual-flange fasteners are substantially comprised of a material selected from the group consisting of hardened steel and titanium.

42. The kit of claim 37, wherein each of said one or more dual-flange fasteners are equipped with one or more metal conical washers or spring washers to help create a snug, detachable coupling between the upper shafts of said dual-flange fasteners and said tuner-mount bar.

43. The kit of claim 37, wherein each of said one or more dual-flange fasteners are equipped with an elastic gasket member to help create a snug, detachable coupling between the upper shafts of said dual-flange fasteners and said tuner-mount bar.

* * * * *